US007638954B2

(12) United States Patent
Kunimatsu et al.

(10) Patent No.: US 7,638,954 B2
(45) Date of Patent: Dec. 29, 2009

(54) LIGHT EMITTING DIODE DRIVE APPARATUS

(75) Inventors: Takashi Kunimatsu, Shiga (JP); Ryutaro Arakawa, Hyogo (JP); Yoshiaki Hachiya, Shiga (JP); Minoru Fukui, Osaka (JP)

(73) Assignee: Panasonic Corporation, Osaka (JP)

( * ) Notice: Subject to any disclaimer, the term of this patent is extended or adjusted under 35 U.S.C. 154(b) by 397 days.

(21) Appl. No.: 11/623,363

(22) Filed: Jan. 16, 2007

(65) Prior Publication Data

US 2007/0170874 A1 Jul. 26, 2007

(30) Foreign Application Priority Data

Jan. 20, 2006 (JP) ..... 2006-012603

(51) Int. Cl.
*G05F 1/00* (2006.01)

(52) U.S. Cl. ..... 315/291; 315/307; 315/312; 323/282; 327/109; 362/227

(58) Field of Classification Search ..... 315/291, 315/169.3, 307, 312; 362/227, 800, 555; 327/109, 514; 323/282, 283
See application file for complete search history.

(56) References Cited

U.S. PATENT DOCUMENTS 5,329,210 A * 7/1994 Peterson et al. ..... 315/246
5,381,018 A * 1/1995 Mojaradi et al. ..... 250/551
6,653,798 B2 * 11/2003 Guthrie et al. ..... 315/200 A
6,870,148 B2 * 3/2005 Dietz et al. ..... 250/205
7,115,888 B2 * 10/2006 Hachiya et al. ..... 250/552

FOREIGN PATENT DOCUMENTS

JP 2001-008443 1/2001

* cited by examiner

*Primary Examiner*—Haissa Philogene
(74) *Attorney, Agent, or Firm*—RatnerPrestia

(57) ABSTRACT

There is provided a light emitting diode drive apparatus which decreases a conducted emission. The light emitting diode drive apparatus includes a light emitting diode to which a voltage is applied from a voltage source, a choke coil connected in series to the light emitting diode, a rectifier diode connected in parallel to the light emitting diode and the choke coil to supply a back electromotive force generated in the choke coil to the light emitting diode, and a switching drive circuit including a switching element and a control circuit block. The switching element determines whether a current is applied or not applied to the light emitting diode. The control circuit block controls on/off timing of the switching element to control the current flowing into the light emitting diode. The choke coil is connected between the light emitting diode and the switching element.

21 Claims, 17 Drawing Sheets

$V_D$
$I_{LED}$
$V_{LED}$
Ch1 20.0V
Ch3 100mA Ω
Ch4 5.0V
M400ns 1.25GS/s IT 80.0ps/pt
A Ch1~78.8V
M400ns 1.25GS/s IT 40.0ps/pt
A Ch1~76.4V
OFF
ON
OFF
(a)
(b)

LIGHT EMITTING DIODE DRIVE APPARATUS

BACKGROUND OF THE INVENTION

1. Field of the Invention

The present invention relates to a light emitting diode (LED) drive apparatus, and particularly to an LED illumination apparatus.

2. Description of the Related Art

Recently, a light emitting diode drive apparatus for driving a light emitting diode has developed and put to practical use. A conventional light emitting diode drive circuit disclosed in Japanese Patent Laid-Open No. 2001-8443 will be described below with reference to FIG. 13. The conventional light emitting diode drive circuit includes a light emitting diode 102, a coil 103 connected to the light emitting diode 102 in series, and a diode 104 connected to the light emitting diode 102 and the coil 103 in parallel. The diode 104 supplies a back electromotive force generated in the coil 103 to the light emitting diode 102.

A direct-current power supply 101 is further provided to apply a pulse voltage to the light emitting diode 102, the coil 103, and the diode 104. A switching element 105 which switches between application and non-application of an output voltage of the direct-current power supply 101 is connected between the light emitting diode 102 and the direct-current power supply 101. For example, the switching element 105 includes a switching transistor and an oscillator. A cathode of the diode 104 is connected to a positive electrode of the direct-current power supply 101 such that a reverse bias is applied to the diode 104.

In the conventional light emitting diode drive circuit, when the switching element 105 is turned on, the direct-current power supply 101 applies the output voltage to the light emitting diode 102 to cause the light emitting diode 102 to emit light. When the switching element 105 is turned off, the light emitting diode 102 emits light by using the back electromotive force of the coil 103.

The conventional light emitting diode drive apparatus has the following problems. The light emitting diode 102 is a capacitive load. In the commercial light emitting diode, a capacitor or a zener diode as an electrostatic protective element is generally connected to the light emitting element in parallel in order to prevent electrostatic discharge damage. Therefore, when the switching element 105 is turned on to transfer a period from a current cutoff period to a current passage period, a fluctuation in potential at a low-potential-side terminal P2 of the coil 103 is increased. At this point, large current flows instantaneously into a parasitic capacitance of the light emitting diode 102 or parasitic capacitances of the capacitor or the zener diode which are connected in parallel to the light emitting diode 102 as the electrostatic protective element. As a result, a forward voltage is instantaneously decreased in the light emitting diode 102. The light emitting diode 102 becomes a noise generating source because the voltage fluctuates between both terminals of the light emitting diode 102. Because this phenomenon is generated in each time when the switching element 105 is turned on, the conducted emission transmitted to the direct-current power supply 101 is increased. Furthermore, when the forward voltage is decreased in the light emitting diode 102, the current flows into the parasitic capacitance to decrease the current flowing into the light emitting diode 102. As a result, sufficient luminance is not obtained.

In view of the foregoing, an object of the invention is to provide a light emitting diode drive apparatus which can decrease the conducted emission with a simple configuration.

SUMMARY OF THE INVENTION

A light emitting diode drive apparatus according to the invention includes at least one light emitting diode; a choke coil; and a switching drive circuit which includes a switching element and a control circuit block. The switching element switches between application and non-application of a current to the light emitting diode and the control circuit block controls on/off timing of the switching element to control the current flowing into the light emitting diode. In the light emitting diode drive apparatus, the choke coil is connected between the light emitting diode and the switching drive circuit.

The light emitting diode drive apparatus of the invention may further include a rectifier diode which supplies back electromotive force generated in the choke coil to the light emitting diode.

According to the light emitting diode drive apparatus having the above configuration of the invention, the potential fluctuation is small at a junction point between the choke coil and the light emitting diode when the switching element transfers a period from a current cutoff period to a current flowing period by turning on the switching element. Therefore, the current does not flow into the parasitic capacitance of the light emitting diode. Even if the capacitor or zener diode as the electrostatic protective element is connected in parallel to the light emitting element in the light emitting diode, the current does not also flow into the parasitic capacitance of the capacitor or zener diode. The voltage between both ends of the light emitting diode is stabilized to eliminate the instantaneous decrease in forward voltage of the light emitting diode. As a result, the noise generated from the light emitting diode can be decreased to decrease the conducted emission transferred to the voltage source. Furthermore, the current flowing into the parasitic capacitance of the light emitting diode can be remarkably decreased, so that the light emitting diode drive apparatus having the high efficiency of power conversion can be realized.

In the light emitting diode drive apparatus of the invention, an anode terminal of the light emitting diode may be connected to a voltage source, one end of the choke coil may be connected to a cathode terminal of the light emitting diode, the rectifier diode may be connected to the anode terminal of the light emitting diode and the other end of the choke coil, and the switching drive circuit may be connected between the other end of the choke coil and a reference potential.

In the light emitting diode drive apparatus of the invention, the cathode terminal of the light emitting diode may be connected to the reference potential, one end of the choke coil may be connected to the anode terminal of the light emitting diode, the rectifier diode may be connected to the cathode terminal of the light emitting diode and the other end of the choke coil, and the switching drive circuit may be connected between the voltage source and the other end of the choke coil. The voltage not lower than the forward voltage of the light emitting diode is not applied to the anode terminal of the light emitting diode by fixing the cathode terminal of the light emitting diode to the reference potential, so that work can safely be performed during disconnection and change of the light emitting diode.

An element for protecting the light emitting diode against the electrostatic discharge damage may be connected in parallel to both terminals of the light emitting diode. The light emitting diode drive apparatus which can decrease the conducted emission can be realized without damaging the light emitting diode against the static electricity or surge voltage by attaching the element for protecting the light emitting diode from the electrostatic discharge damage. A light emitting diode product into which an electrostatic discharge damage protection circuit is inserted may be used. The conducted emission can be decreased because the voltage between the both ends of the light emitting diode does not fluctuate at the moment when the switching element switches from turn-off to turn-on.

The light emitting diode may be formed by connecting the light emitting element and a capacitor in parallel. The light emitting diode may include the light emitting element and a zener diode which is connected in antiparallel between the anode terminal and the cathode terminal of the light emitting element. The light emitting diode drive apparatus of the invention may further include a rectifier which rectifies an alternating-current voltage when the voltage source is an alternating-current power supply which outputs the alternating-current voltage.

The control circuit block may includes a constant current source having one end connected to the rectifier; a regulator which is connected to other end of the constant current source, and which outputs a start-up signal when an output voltage of the constant current source is not lower than a predetermined value or outputs a stop signal when the output voltage of the constant current source is lower than the predetermined value; a current detection circuit which detects a current flowing into the switching element; a control circuit which intermittently performs on/off control of the switching element at a predetermined oscillation frequency based on an output signal of the current detection circuit such that the current flowing into the light emitting diode is kept constant; and a start/stop circuit which controls a start and a stop of the control circuit based on the start-up signal and the stop signal from the regulator.

The light emitting diode drive apparatus of the invention may further include a capacitor having one end connected to the regulator and other end connected to a reference potential of the rectifier or a junction point between the choke coil and a cathode terminal of the diode.

The light emitting diode drive apparatus which includes the regulator allows the reference voltage to be kept constant in operating of the control circuit. Accordingly, the stable control for the switching element can be realized.

The control circuit does not perform the on/off control of the switching element while the reference voltage is smaller than a predetermined value. The control circuit starts the operation after the reference voltage reaches the predetermined value. Therefore, the control circuit can stably operate.

The light emitting diode drive apparatus may include an input voltage detection circuit which detects a voltage outputted from the rectifier and compares the detected voltage with a predetermined value to output a light emitting signal or an extinction signal for controlling light emission or extinction of the light emitting diode respectively and the start/stop circuit may output the stop signal to the control circuit when the regulator outputs the stop signal, and output the light emitting signal or the extinction signal of the input voltage detection circuit to the control circuit when the regulator outputs the start-up signal.

The input voltage detection circuit may include plural resistors which are connected in series and are applied with the output voltage of the rectifier directly or through a resistor inserted between the rectifier and the input voltage detection circuit; and a comparator having a positive input terminal applied with a direct current voltage divided by the plural resistors and a negative input terminal applied with an input reference voltage which is a reference. According to the above configuration, a period during which the light emitting diode emits light and a period during which the light emitting diode extinguishes light can correctly be regulated in a double period (for example, 100 Hz/120 Hz in the case where a commercial power supply is used) of a frequency of an alternating-current power supply. A voltage level in which the on/off control of the switching element can be performed can arbitrarily set for the change in voltage outputted by the rectifier, by changing the value of the resistor inserted between the rectifier and the input voltage detection circuit. Therefore, the safety light emitting diode drive apparatus having the high efficiency of power conversion and capable of adjusting the complicated light intensity, can be realized.

The input voltage detection circuit may include plural resistors which are applied with the output voltage of the rectifier directly or through the resistor inserted between the rectifier and the input voltage detection circuit and which outputs a first dividing voltage and a second dividing voltage lower than the first dividing voltage; a first comparator which has a positive input terminal applied with the first dividing voltage and a negative input terminal applied with an input reference voltage which is a reference; a second comparator which has a negative input terminal applied with the second dividing voltage and a positive input terminal applied with the input reference voltage; and an AND circuit which inputs output signals of the first and second comparators. According to the above configuration, an upper limit and a lower limit of the voltage level in which the on/off control of the switching element can be performed can correctly be set for the change in voltage outputted by the rectifier. The upper limit and the lower limit of the voltage level in which the on/off control of the switching element can be performed can be arbitrarily set for the change in voltage outputted by the rectifier by changing the value of the resistor inserted between the rectifier and the input voltage detection circuit. The electric power loss caused by a resistor in the input voltage detection circuit can be decreased by the use of the resistor having a high resistance.

The current detection circuit may detect the current flowing into the switching element by comparing an on-state voltage of the switching element with a detection reference voltage which is a reference. Therefore, the electric power loss is decreased, and a peak value of the current of the switching element, that is, the peak value of the current flowing into the light emitting diode can be detected. The light emitting diode driving semiconductor circuit having the high efficiency of power conversion can be realized.

The switching drive circuit may further include another switching element having one end connected to a junction point between the choke coil and the switching element to switch on/off by the same control as the switching element by the control circuit, a current flowing into the other switching element, the current being smaller than a current flowing into the switching element and having a constant current ratio to the current flowing into the switching element; and a resistor which is connected in series between the other end of the other switching element and a reference potential. The current detection circuit may detect the current of the switching element by comparing a voltage between both ends of the resistor with the detection reference voltage which is the reference.

Accordingly, the electric power loss is decreased because the large current is not directly detected by the resistor, so that the peak value of the current of the switching element, that is, the peak value of the current flowing into the light emitting diode can be detected. The light emitting diode driving semiconductor circuit having the high efficiency of power conversion can be realized.

The switching drive circuit may further include an external detection terminal connected to the current detection circuit, and an on-period may be changed in the intermittent on/off control of the switching element to adjust a level of a constant current flowing into the light emitting diode by changing a value of the detection reference voltage inputted to the external detection terminal. Therefore, the light emitting diode drive circuit having the brightness control function and the high efficiency of power conversion can be realized.

The light emitting diode drive apparatus of the invention may include a soft-start circuit connected between the current detection circuit and an external detection terminal to which the detection reference voltage is inputted. The soft-start circuit may output the detection reference voltage such that the detection reference voltage is gradually increased until the detection reference voltage reaches a constant value when the light emitting signal is inputted from the start/stop circuit. Therefore, rush current generated in the start-up can be prevented and light intensity of the light emitting diode can gradually be enhanced.

According to the invention, there is obtained an effect that light emitting diode drive apparatus which decreases the conducted emission can be realized. According to the invention, the light emitting diode drive apparatus can perform the constant current drive without influence of the fluctuation in input voltage. According to the invention, the light emitting diode drive apparatus capable of the brightness control and having the high efficiency of power conversion can be realized.

DETAILED DESCRIPTION OF THE PREFERRED EMBODIMENTS

Embodiments which specifically show the best mode for carrying out the invention, will be described below with reference the accompanying drawings.

First Embodiment

Figure 1:
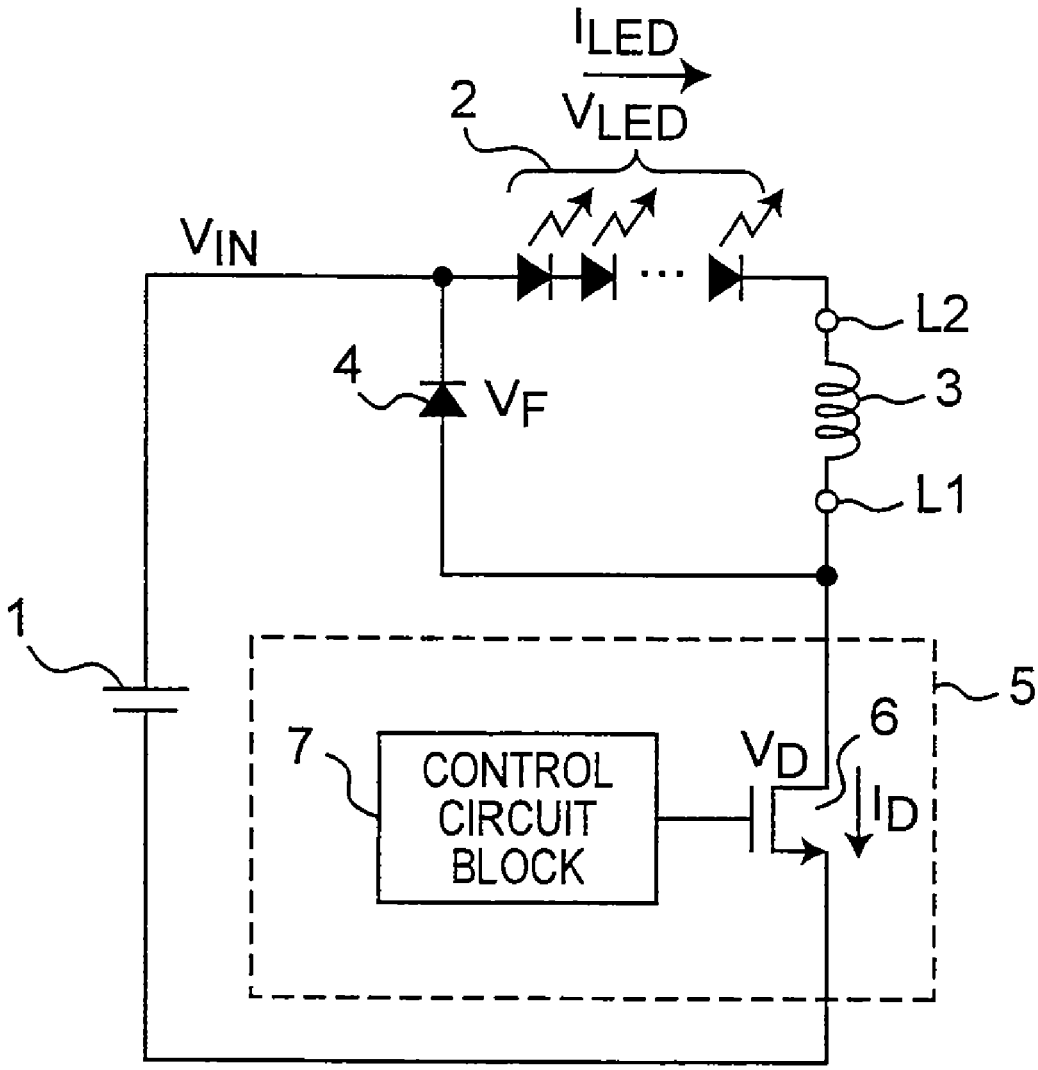
FIG. 1 is a circuit diagram showing a light emitting diode drive apparatus according to a first embodiment of the invention.

A light emitting diode drive apparatus according to a first embodiment of the invention will be described with reference to FIGS. 1 to 4. FIG. 1 shows the light emitting diode drive apparatus of the first embodiment. The light emitting diode drive apparatus of the first embodiment includes a light emitting diode (LED) 2, a choke coil 3 of which one end is connected to a cathode terminal of the light emitting diode 2, and a rectifier diode 4 having an anode terminal connected to the other end of the choke coil 3 and having a cathode terminal connected to a high-potential terminal of a direct-current power supply 1 and an anode terminal of the light emitting diode 2. The rectifier diode 4 supplies the back electromotive force generated in the choke coil 3 to the light emitting diode 2. The anode terminal of the light emitting diode 2 is connected to the high-potential terminal of the direct-current power supply 1 which is of a voltage source. The light emitting diode 2 is a light emitting diode group including plural light emitting diodes connected in series. However, the number of the light emitting diode included in the light emitting group is not limited to the number shown in FIG. 1, but at least one light emitting diode may be used as the light emitting diode 2.

The light emitting diode drive apparatus also includes a switching drive circuit 5 which controls the current flowing into the light emitting diode. The switching drive circuit 5 includes a switching element 6 of which one end is connected to the choke coil 3 and the other end is connected to the low-potential terminal of the direct-current power supply 1 to switches between application and non-application of the output voltage by the direct-current power supply 1, and a control circuit block 7 which is connected to a control terminal of the switching element 6 to control on/off timing of the switching element 6. The control circuit block 7 intermittently controls the on/off timing of the switching element 6 with a predetermined oscillation frequency.

The light emitting diode drive apparatus of the first embodiment is different from the conventional configuration in that the choke coil 3 is connected between the light emitting diode 2 and the switching drive circuit 5.

Figure 2:
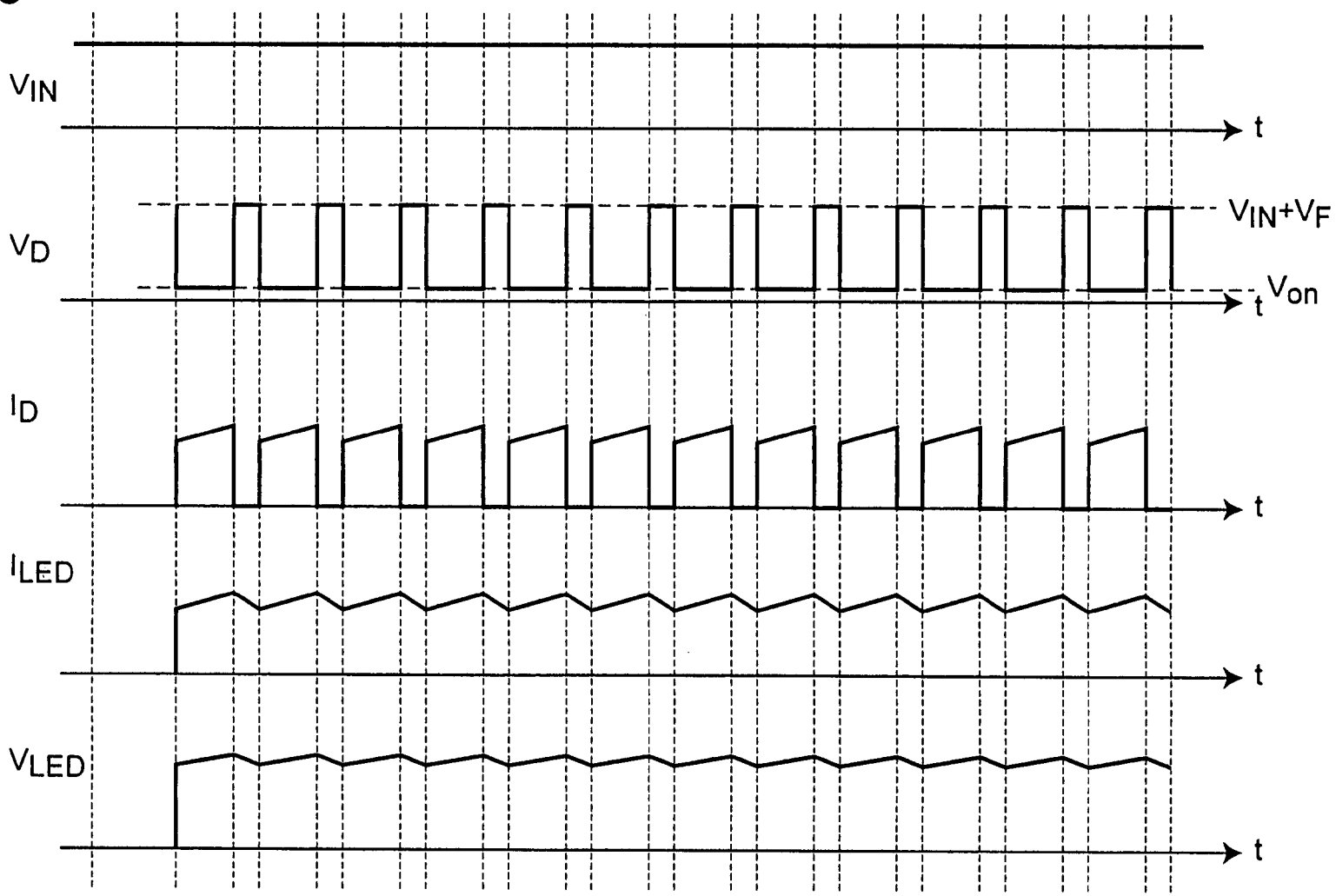
FIG. 2 shows waveforms of each voltage and each current in the first embodiment.

Then, an operation of the light emitting diode drive apparatus of the first embodiment will be described with reference to FIG. 2. FIG. 2 sequentially shows a waveform of an output voltage $V_{IN}$ of the direct-current power supply 1, a waveform of a voltage $V_D$ between a high-potential-side terminal of the switching element 6 and a reference potential, a waveform of a current $I_D$ flowing into the switching element 6, a waveform of a current $I_{LED}$ flowing into the light emitting diode 2, and a waveform of a forward voltage $V_{LED}$ of the light emitting diode 2 (that is, the waveform of the voltage difference between the anode terminal and the cathode terminal of the light emitting diode 2).

When the switching element 6 is turned from off to on based on the desired timing determined by the control circuit block 7, the direct-current power supply 1 applies the output voltage $V_{IN}$ to the light emitting diode 2 and the choke coil 3, and the voltage $V_D$ of the switching element 6 is decreased to an on-state voltage $V_{on}$ of the switching element 6. That is, the voltage at the junction point L1 between the choke coil 3 and the switching element 6 is rapidly decreased to the on-state voltage $V_{on}$ at the switching element 6.

While the switching element 6 is turned on, the current is flowing into a path such as the light emitting diode 2→the choke coil 3→the switching element 6, and the waveform of the current $I_{LED}$ flowing into the light emitting diode 2 becomes a current waveform having a gradient increased with time. The gradient is determined by the output voltage $V_{IN}$ of the direct-current power supply 1 and an inductance value L of the choke coil 3.

The direct-current power supply 1 always applies the output voltage $V_{IN}$ to the anode terminal of the light emitting diode 2. Irrespective of the turn-on and turn-off of the switching element, the cathode terminal voltage (voltage at a junction point L2) of the light emitting diode 2 is the voltage ($V_{IN}$-$V_{LED}$) which is decreased by subtracting a potential difference (forward voltage $V_{LED}$ of the light emitting diode 2) which is generated by the flow of the current $I_{LED}$ into the light emitting diode 2 from the output voltage $V_{IN}$ at the direct-current power supply 1. Therefore, the potential between the terminals of the light emitting diode 2 is not largely changed at the moment when the switching element 6 is turned on.

The forward voltage $V_{LED}$ of the light emitting diode 2 is slowly increased in association with the increased in current $I_{LED}$ flowing into the light emitting diode 2, while the switching element 6 is turned on. Therefore, the potential difference between both terminals of the light emitting diode 2 is slowly enlarged.

When the switching element 6 is turned off, because the output voltage $V_{IN}$ of the direct-current power supply 1 is interrupted and not applied to the light emitting diode 2 and the choke coil 3, the back electromotive force is generated in the choke coil 3. The current is flowing into the path such as the choke coil 3→the rectifier diode 4→the light emitting diode 2→the choke coil 3 by the back electromotive force of the choke coil 3. The waveform of the current $I_{LED}$ flowing into the light emitting diode 2 becomes a current waveform having a gradient decreased with time. The gradient is determined by the inductance value L of the choke coil 3 and a total voltage ($V_F$+$V_{LED}$) of a forward voltage $V_F$ of the rectifier diode 4 and the forward voltage $V_{LED}$ of the light emitting diode 2.

The potential difference between both terminals of the choke coil becomes a total value ($V_{LED}$+$V_F$) of the forward voltage $V_{LED}$ of the light emitting diode 2 and the forward voltage $V_F$ of the rectifier diode 4 while the switching element 6 is turned off. Because the voltage of the junction point L2 between the light emitting diode 2 and the choke coil 3 is fixed to the voltage ($V_{IN}$−$V_{LED}$) which is lower than the output voltage $V_{IN}$ of the direct-current power supply 1 by the forward voltage $V_{LED}$ of the light emitting diode 2, the voltage of the junction point L1 between the choke coil 3 and the switching element 6 is instantaneously increased to the voltage ($V_{IN}$+$V_F$) which is obtained by adding the potential difference ($V_{LED}$+$V_F$) generated between both terminals of the choke coil 3 to the voltage ($V_{IN}$−$V_{LED}$) of the junction point L2 between the light emitting diode 2 and the choke coil 3.

On the other hand, because the voltage of the junction point L2 between the light emitting diode 2 and the choke coil 3 is fixed to the voltage ($V_{IN}$−$V_{LED}$) which is lower than the output voltage $V_{IN}$ of the direct-current power supply 1 by the forward voltage $V_{LED}$ Of the light emitting diode 2, the potential between both terminals of the light emitting diode 2 does not fluctuate largely at the moment when the switching element 6 is turned off.

The potential difference between the terminals of the light emitting diode 2 is slowly decreased because the forward voltage $V_{LED}$ is slowly decreased in association with the decreased in current $I_{LED}$ flowing into the light emitting diode 2 while the switching element 6 is turned off.

Thus, when the switching element 6 switches between turn-on and turn-off, the voltage does not fluctuate largely at the junction point L2 between the light emitting diode 2 and the choke coil 3 while the voltage fluctuates largely at the junction point L1 between the choke coil 3 and the switching element 6.

Figures 3A, 3B:
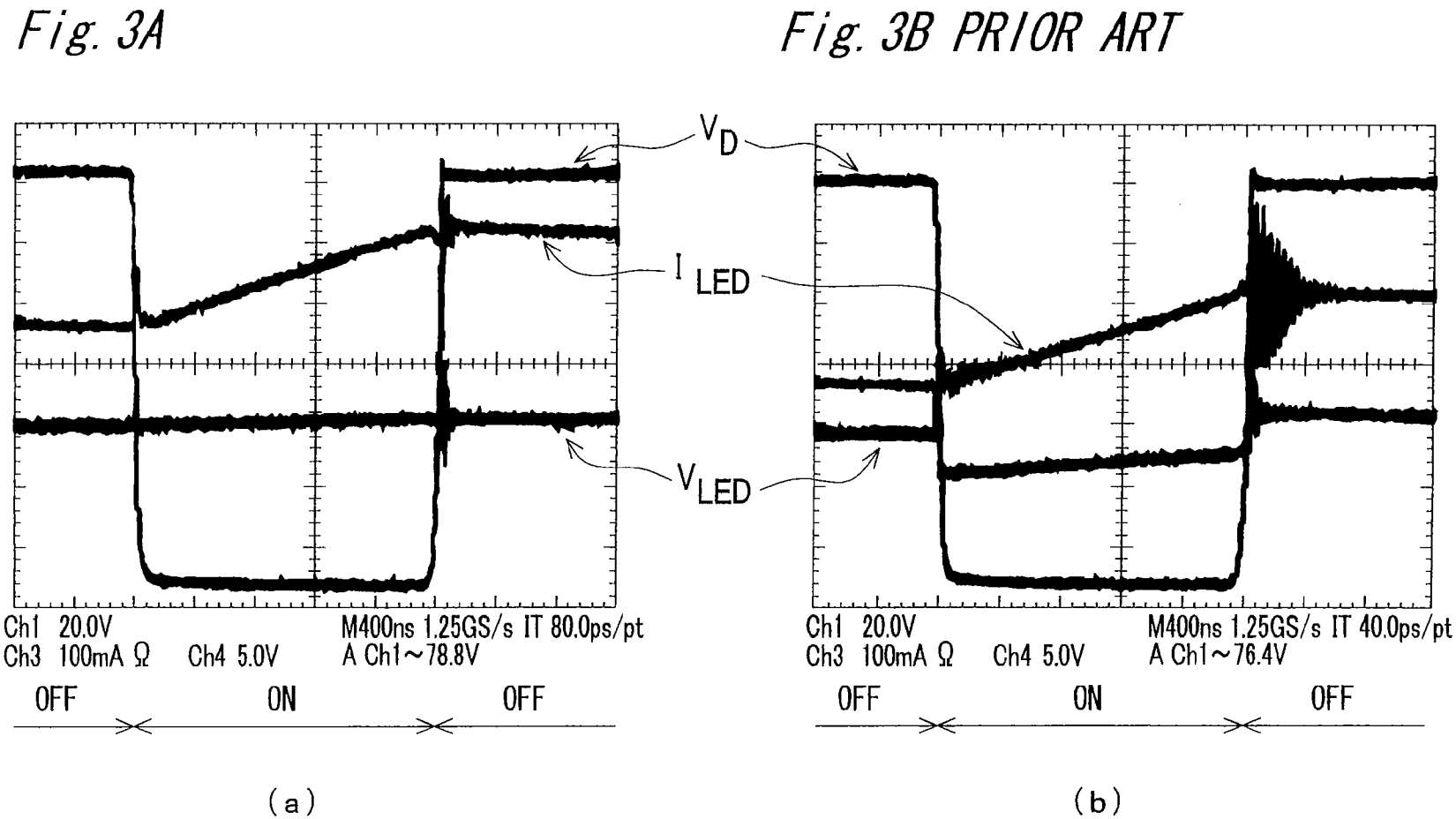
Fig. 3B PRIOR ART
FIG. 3A shows a voltage and a current of the light emitting diode in the first embodiment.
FIG. 3B shows a voltage and a current of a conventional light emitting diode.
Figure 13:
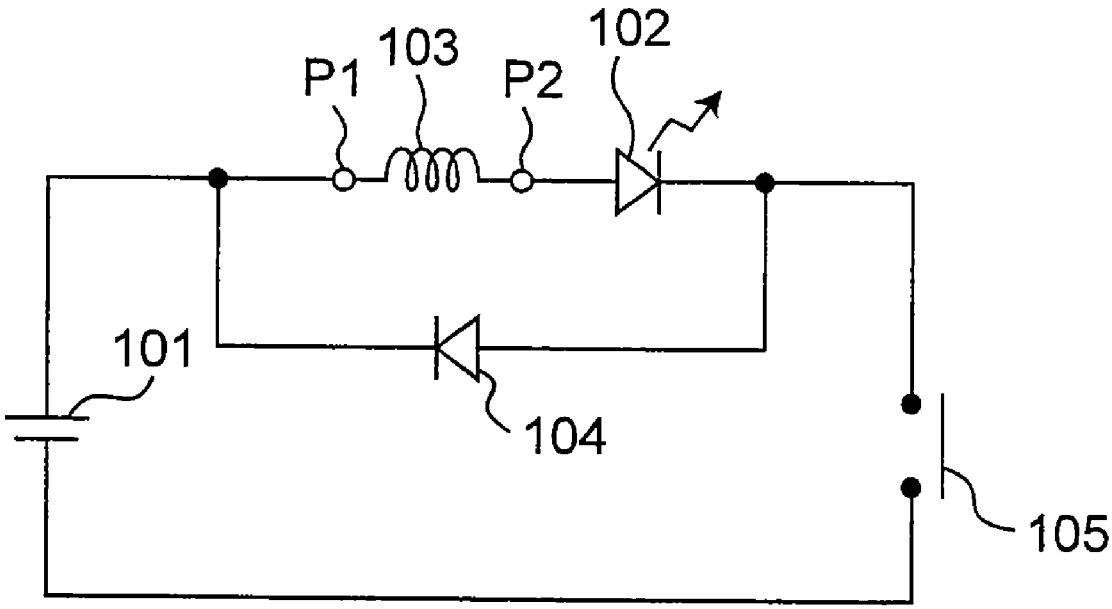
Fig.13 PRIOR ART
FIG. 13 shows a schematic configuration of the conventional light emitting diode drive apparatus.

FIG. 3A shows the voltage waveform of each part when the switching element 6 of the light emitting diode drive apparatus of the first embodiment is turned off→on→off. For the purpose of comparison between the first embodiment and the prior art, FIG. 3B shows the voltage waveform of each part when the switching element 105 of the conventional light emitting diode drive apparatus shown in FIG. 13 is turned off→on→off. In FIGS. 3A and 3B, a vertical axis indicates the waveform of the voltage $V_D$ between both terminals of the switching element, the waveform of the current $I_{LED}$ flowing into the light emitting diode, and the waveform of the voltage $V_{LED}$ between both terminals of the light emitting diode. The indicated waveform of the voltage $V_D$ between the terminals of the switching element is 20 v/div, the indicated waveform of the current $I_{LED}$ flowing into the light emitting diode is 100 mA/div, and the indicated waveform of the voltage $V_{LED}$ between the terminals of the light emitting diode is 5 V/div. A horizontal axis indicates a time, and the indicated time is 400 ns/div.

As is clear from FIG. 3A, in the light emitting diode drive apparatus of the first embodiment, the voltage $V_{LED}$ between the terminals of the light emitting diode does not fluctuate at the moment when the switching element 6 is turned on and off. On the other hand, as is clear from FIG. 3B, in the conventional light emitting diode drive apparatus, the voltage $V_{LED}$ between the terminals of the light emitting diode fluctuates rapidly from about 9V to about 6V at the moment when the switching element is turned on. In the conventional light emitting diode drive apparatus, the voltage $V_{LED}$ between the terminals of the light emitting diode fluctuates rapidly from about 8V to about 11V at the moment when the switching element is turned off.

When the choke coil 3 is connected between the switching element 6 and the light emitting diode 2 such as the first embodiment, the potential between the terminals of the light emitting diode 2 does not fluctuate largely even if the potential at the junction point L1 between the choke coil 3 and the switching element 6 fluctuates largely by switching the switching element 6 between turn-on and turn-off. Therefore, the large current is not charged in the parasitic capacitance of the light emitting diode.

Figure 4A:
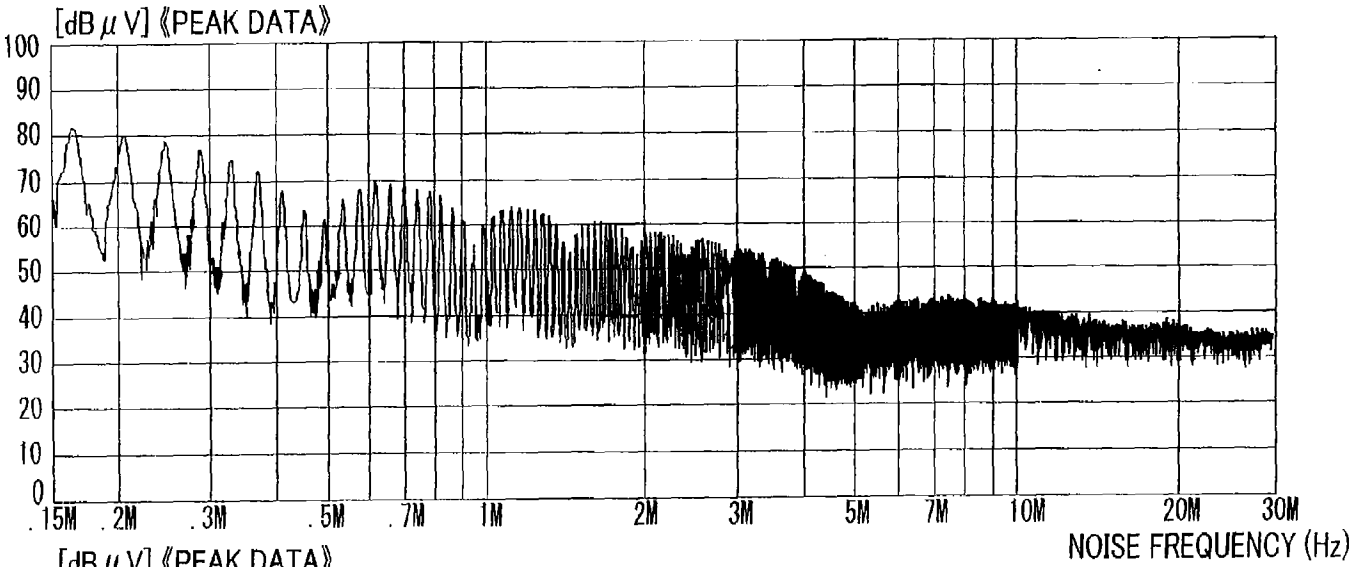
FIG. 4A shows a conducted emission waveform generated by the light emitting diode drive apparatus of the first embodiment.
Figure 4B:
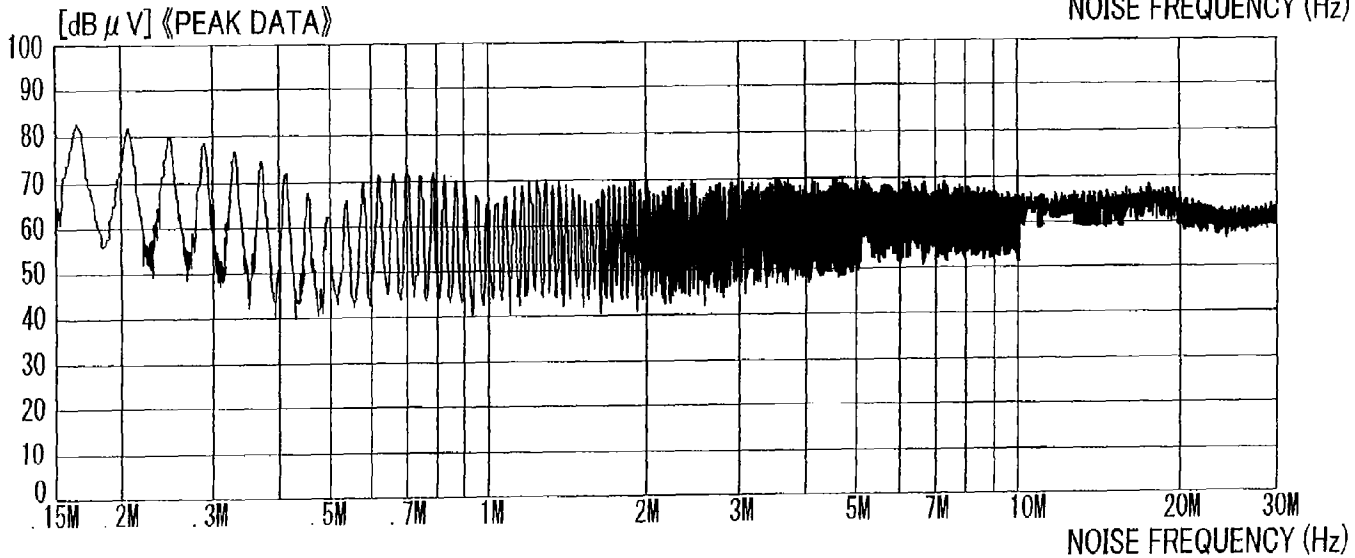
Fig. 4B PRIOR ART
FIG. 4B shows a conducted emission waveform generated by the conventional light emitting diode drive apparatus.

FIG. 4A shows a conducted emission waveform generated by the light emitting diode drive apparatus of the first embodiment. For the purpose of comparison between the first embodiment and the prior art, FIG. 4B shows the conducted emission waveform generated by the conventional light emitting diode drive apparatus shown in FIG. 13. In FIGS. 4A and 4B, the horizontal axis indicates a noise frequency, and the vertical axis indicates the conducted emission. As is clear from FIGS. 4A and 4B, in light emitting diode drive apparatus of the first embodiment, a noise level is remarkably decreased in a frequency range not lower than 1 MHz as compared with the conventional light emitting diode drive apparatus.

By connecting the choke coil 3 between the switching element 6 and the light emitting diode 2 such as the first embodiment, the potential between the terminals of the light emitting diode 2 does not fluctuate largely when the switching element 6 switches between turn-on and turn-off. The light emitting diode 6 does not become the noise source. Therefore, the conducted emission transferred to the direct-current power supply 1 can be decreased.

Figure 14:
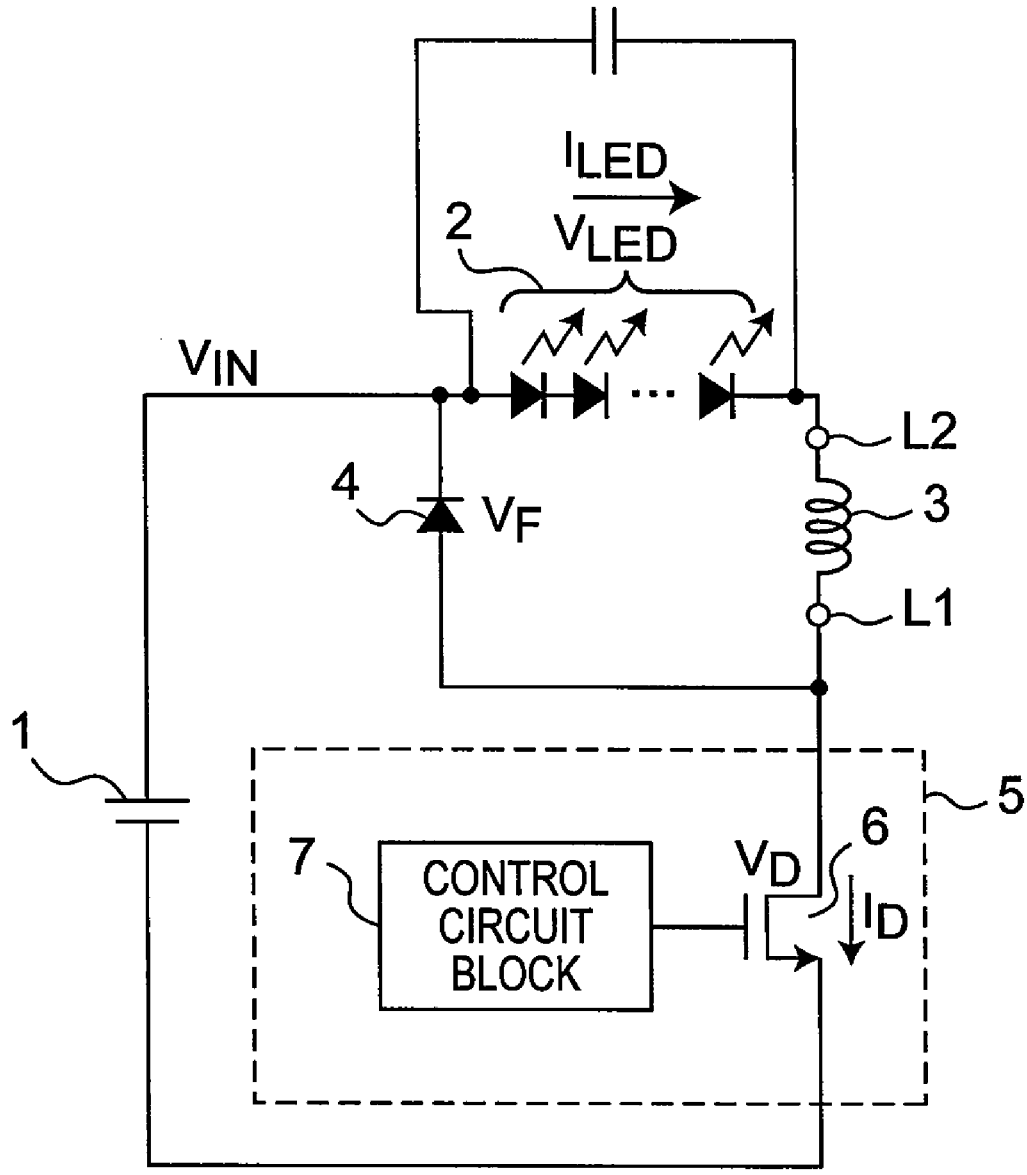
FIG. 14 is a circuit diagram showing a light emitting diode drive apparatus as shown in FIG. 1 including a capacitor connected in parallel with a light emitting diode.
Figure 15:
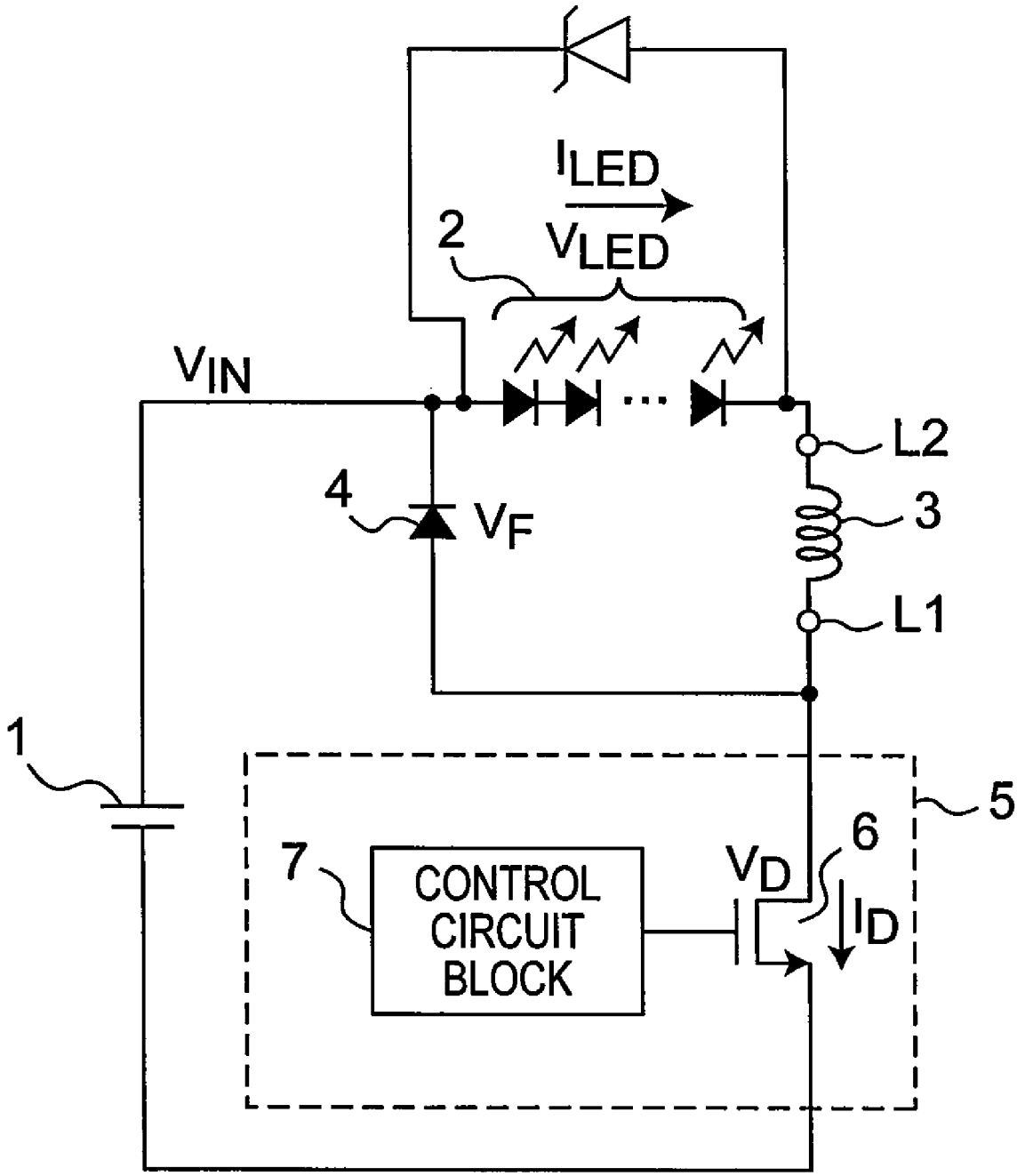
FIG. 15 is a circuit diagram showing a light emitting diode drive apparatus as shown in FIG. 1 including a zener diode connected in antiparallel with a light emitting diode.

The element for protecting the light emitting diode 2 from the electrostatic discharge damage may be connected in parallel to the terminals of the light emitting diode 2, as shown in FIG. 14. For example, in order to prevent the electrostatic discharge damage, a capacitor may be connected in parallel with the light emitting diode 2 (as shown in FIG. 14), or a zener diode may be connected in antiparallel with the light emitting diode 2 (as shown in FIG. 15). Alternatively, a light emitting diode product having an electrostatic discharge damage preventing element, such as the capacitor or the zener diode, incorporated along with the light emitting element may be used. The same effect as the first embodiment is obtained in these cases.

In FIG. 1 of the first embodiment, the direct-current power supply 1 is used as the voltage source. The voltage source is not limited to the direct-current power supply, but an alternating-current power supply and a rectifier which rectifies the alternating-current voltage may be used. A smoothing capacitor may be connected between the high-potential side and the low-potential side of the rectifier. These configurations may be used in the following embodiments.

Second Embodiment

Figure 5:
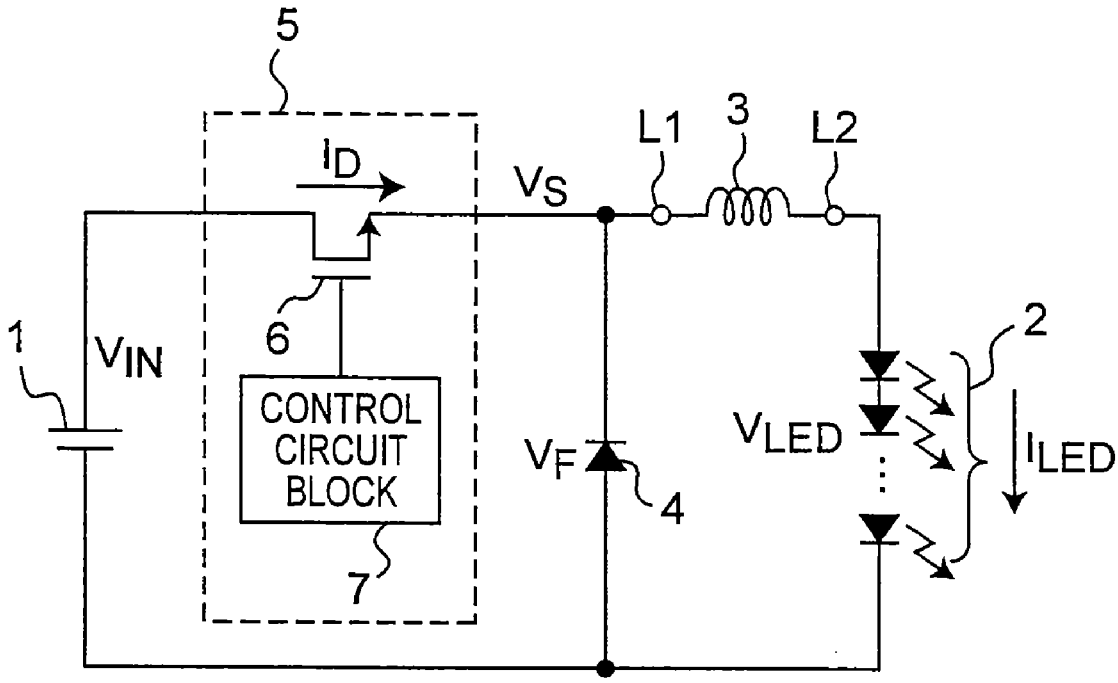
FIG. 5 is a circuit diagram showing a light emitting diode drive apparatus according to a second embodiment of the invention.
Figure 6:
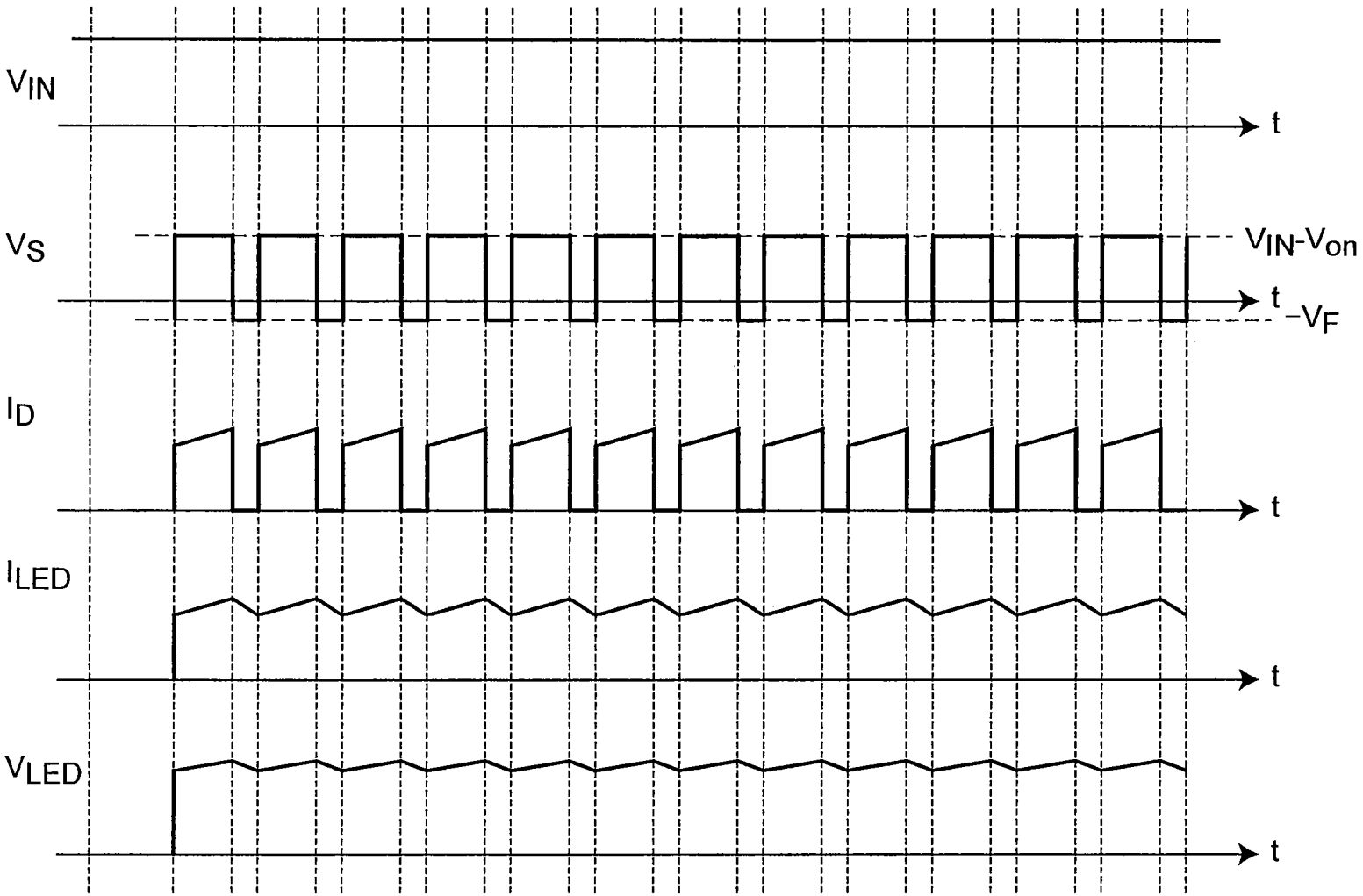
FIG. 6 shows waveforms of each voltage and each current in the second embodiment.

A light emitting diode drive apparatus according to a second embodiment of the invention will be described with reference to FIGS. 5 and 6. FIG. 5 shows the light emitting diode drive apparatus of the second embodiment. The components included in the light emitting diode drive apparatus of the second embodiment are similar to the components included in the light emitting diode drive apparatus of the first embodiment. However, the second embodiment differs from the first embodiment in connection relationship among the components.

In the switching element 6 of the switching drive circuit 5 of the second embodiment, one end is connected to the high-potential-side terminal of the direct-current power supply 1, and the other end is connected to one end of the choke coil 3. The other end of the choke coil 3 is connected to the anode terminal of the light emitting diode 2. In the rectifier diode 4, the cathode terminal is connected between the switching element 6 and the choke coil 3, and the anode terminal is connected to the cathode terminal of the light emitting diode 2. The cathode terminal of the light emitting diode 2 and the anode terminal of the rectifier diode 4 are connected to the low-potential-side terminal of the direct-current power supply 1.

Then, the operation of the light emitting diode drive apparatus of the second embodiment will be described with reference to FIG. 6. FIG. 6 sequentially shows a waveform of the output voltage $V_{IN}$ of the direct-current power supply 1, a waveform of a voltage $V_S$ between a low-potential-side terminal of the switching element 6 and the reference potential terminal, a waveform of the current $I_D$ flowing into the switching element 6, a waveform of the current $I_{LED}$ flowing into the light emitting diode 2, and a waveform of the forward voltage $V_{LED}$ of the light emitting diode 2 (that is, the waveform of the voltage difference between the anode terminal and the cathode terminal).

When the switching element 6 is turned on based on the desired timing determined by the control circuit block 7, the direct-current power supply 1 applies the output voltage $V_{IN}$ to the choke coil 3 and the light emitting diode 2. The waveform of the voltage $V_S$ between the low-potential-side terminal of the switching element 6 and the reference potential becomes the voltage ($V_{IN}-V_{on}$) which is decreased by the on-state voltage $V_{on}$ of the switching element 6. The current flows into the path of the switching element 6→the choke coil 3→the light emitting diode 2, and the waveform of the current $I_{LED}$ flowing into the light emitting diode 2 becomes the waveform having the gradient increased with time. The gradient is determined by the output voltage $V_{IN}$ of the direct-current power supply 1 and the inductance value L of the choke coil 3.

When the switching element 6 is turned off, because the application of output voltage $V_{IN}$ of the direct-current power supply 1 is interrupted, the back electromotive force is generated in the choke coil 3. The current flows into the path of the choke coil 3→the light emitting diode 2→the rectifier diode 4→the choke coil 3 by the back electromotive force. The waveform of the current $I_{LED}$ flowing into the light emitting diode 2 becomes the waveform having the gradient decreased with time. The gradient is determined by the inductance value L of the choke coil 3 and the total voltage ($V_F+V_{LED}$) of the forward voltage $V_F$ of the rectifier diode 4 and the forward voltage $V_{LED}$ of the light emitting diode 2.

The cathode terminal of the light emitting diode 2 is connected to the low-potential-side terminal of the direct-current power supply 1, and the cathode terminal is always the reference potential.

When the switching element 6 is turned on, the voltage at the junction point L1 between the switching element 6 and the choke coil 3 is increased to the voltage ($V_{IN}-V_{on}$) which is lowered by the on-state voltage $V_{on}$ at the switching element 6 from the output voltage $V_{IN}$ of the direct-current power supply 1.

On the other hand, the voltage at the junction point L2 between the choke coil 3 and the light emitting diode 2 is fixed to the potential difference (the forward voltage $V_{LED}$ of the light emitting diode 2) generated by the current $I_{LED}$ which is flowing into the light emitting diode 2 by the back electromotive force of the choke coil 3 while the switching element 6 is turned off. Therefore, the potential between both terminals of the light emitting diode 2 does not fluctuate largely at the moment when the switching element 6 is turned on. The forward voltage $V_{LED}$ at the light emitting diode 2 is slowly increased in association with the increased in current $I_{LED}$ flowing into the light emitting diode 2, while the switching element 6 is turned on. Therefore, the potential difference between the terminals of the light emitting diode 2 is slowly enlarged.

When the switching element 6 is turned off, the potential difference between both terminals of the choke coil 3 becomes the total value ($V_{LED}$+$V_F$) of the forward voltage $V_{LED}$ of the light emitting diode 2 and the forward voltage $V_F$ of the rectifier diode 4 by the back electromotive force generated in the choke coil 3. Because the voltage at the junction point L2 between the choke coil 3 and the light emitting diode 2 is fixed to the voltage ($V_{LED}$) which is higher than the reference potential of the direct-current power supply 1 by the forward voltage $V_{LED}$ of the light emitting diode 2, the voltage at the junction point L1 between the switching element 6 and the choke coil 3 is instantaneously decreased to the voltage ($-V_F$) which is obtained by subtracting the potential difference ($V_{LED}$+$V_F$) generated between the terminals of the choke coil 3 from the voltage ($V_{LED}$) at the junction point L2.

However, because the voltage at the junction point L2 is fixed to the voltage ($V_{LED}$) which is higher than the reference potential of the direct-current power supply 1 by the forward voltage $V_{LED}$ Of the light emitting diode 2, the potential between both terminals of the light emitting diode 2 does not fluctuate largely at the moment when the switching element 6 is turned off. The potential difference between both terminals of the light emitting diode 2 is slowly decreased, because the forward voltage $V_{LED}$ of the light emitting diode 2 is slowly decreased in association with the decrease in current $I_{LED}$ flowing into the light emitting diode 2 while the switching element 6 is turned off.

Thus, even if the voltage $V_S$ between the low-potential-side terminal of the switching element 6 and the reference potential fluctuates largely when the switching element 6 switches between turn-on and turn-off, the potential $V_{LED}$ between both terminals of the light emitting diode 2 does not fluctuate largely, so that the large current is not charged in the parasitic capacitance of the light emitting diode 2. The light emitting diode 2 does not become the noise source, and the conducted emission transmitted to the direct-current power supply 1 can be decreased.

In the second embodiment, because the light emitting diode 2 is connected between the low potential side of the switching drive circuit 5 and the reference potential of the direct-current power supply 1, the voltage at the cathode terminal of the light emitting diode 2 is fixed to the reference potential. The voltage not lower than the forward voltage $V_{LED}$ of the light emitting diode 2 is not applied to the anode terminal of the light emitting diode 2, so that the work can safely be performed during disconnection and change of the light emitting diode.

Figure 16:
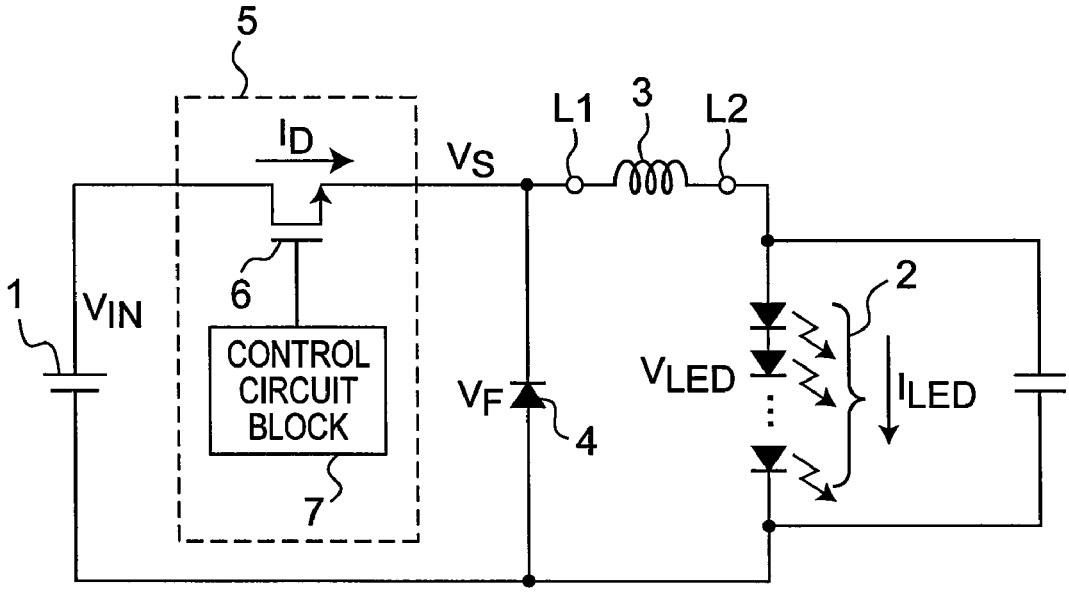
FIG. 16 is a circuit diagram showing a light emitting diode drive apparatus as shown in FIG. 5 including a capacitor connected in parallel with a light emitting diode.
Figure 17:
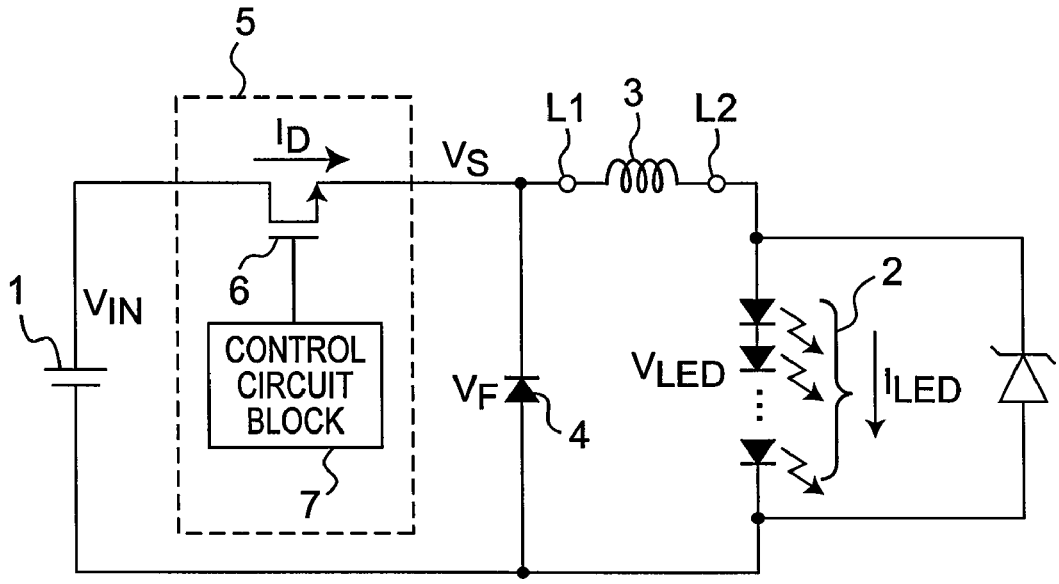
FIG. 17 is a circuit diagram showing a light emitting diode drive apparatus as shown in FIG. 5 including a zener diode connected in antiparallel with a light emitting diode.

In order to prevent the electrostatic discharge damage, a capacitor may be connected in parallel with the light emitting diode 2 (as shown in FIG. 16), or a zener diode may be connected in antiparallel with the light emitting diode 2 (as shown in FIG. 17). Alternatively, a light emitting diode product which has an electrostatic discharge damage preventing device such as the capacitor or the zener diode precedently incorporated along with the light emitting element may be used. The same effect as the second embodiment is obtained in these cases.

Third Embodiment

Figure 7:
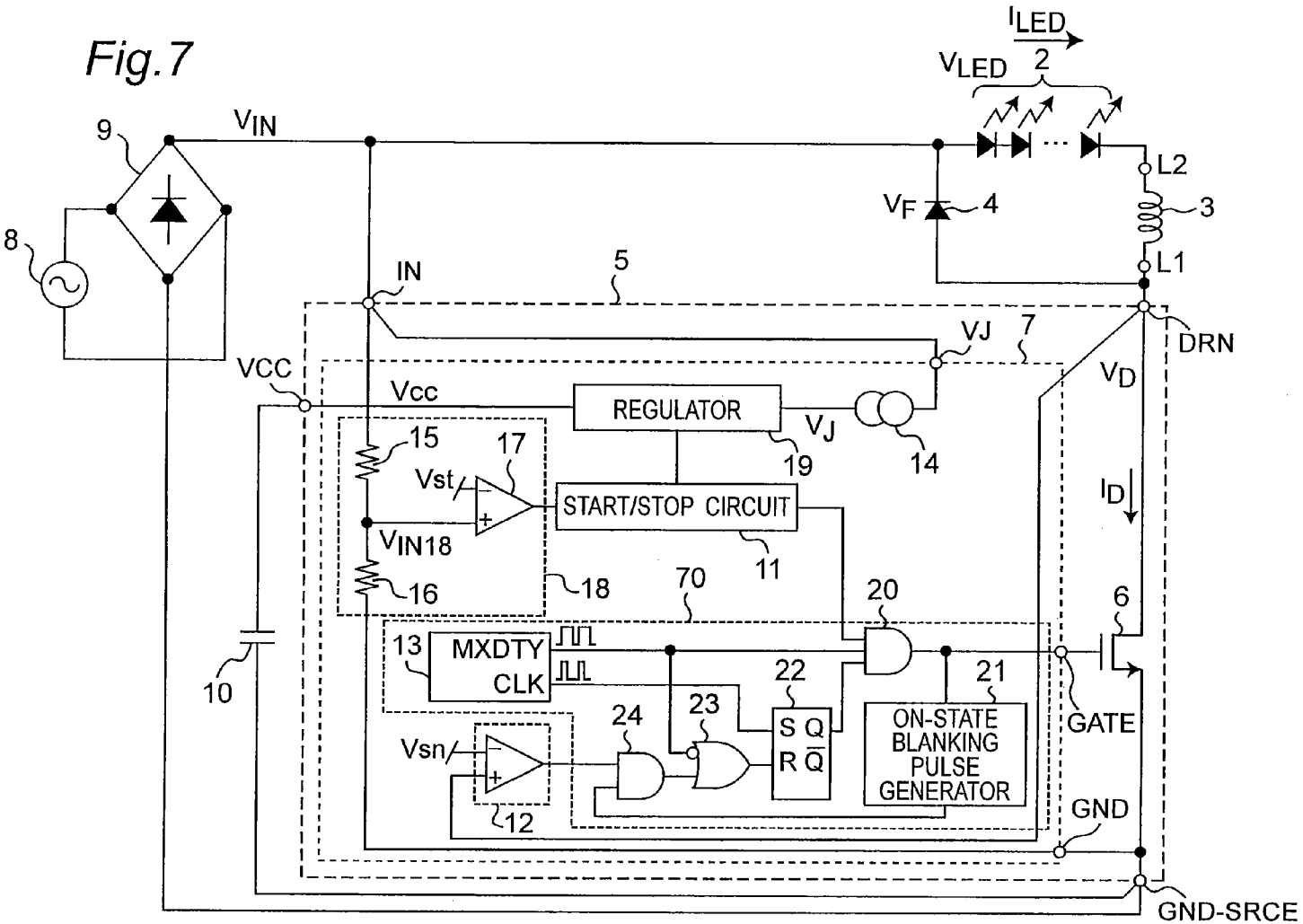
FIG. 7 is a circuit diagram showing a light emitting diode drive apparatus according to a third embodiment of the invention.

A light emitting diode drive apparatus according to a third embodiment of the invention will be described with reference to FIGS. 7 and 8. FIG. 7 shows the light emitting diode drive apparatus of the third embodiment. The third embodiment concretely shows an example of the control circuit block 7 of the first embodiment.

The voltage source of the third embodiment differs from the voltage source of the first embodiment in that an alternating-current power supply 8 for generating an alternating-current voltage is used and a rectifier 9 is connected to the alternating-current power supply 8. In the third embodiment, the rectifier 9 is a full wave rectifier which outputs the full wave rectified direct-current voltage $V_{IN}$. The high potential side of the rectifier 9 is connected to the anode terminal of the light emitting diode 2 and the cathode terminal of the rectifier diode 4, and the low potential side of the rectifier 9 is connected to a low-potential-side terminal GND-SRCE of the switching drive circuit 5.

The switching drive circuit 5 of the third embodiment includes an input terminal IN, a high-potential-side terminal DRN, the low-potential-side terminal GND-SRCE, and a reference voltage terminal VCC. The input terminal IN is connected to the high potential side of the rectifier 9 and is applied with the direct-current voltage $V_{IN}$. The high-potential-side terminal DRN is connected to the junction point between the choke coil 3 and anode terminal of the rectifier diode 4. The low-potential-side terminal GND-SRCE is connected to a ground terminal GND of the control circuit block 7 and has a ground potential (reference potential). In the light emitting diode drive apparatus of the embodiment, a capacitor 10 is connected between the reference voltage terminal VCC and the low-potential-side terminal GND-SRCE.

The switching drive circuit 5 includes the switching element 6 and the control circuit block 7. The switching element 6 is connected between the high-potential-side terminal DRN and the low-potential-side terminal GND-SRCE. The control terminal of the switching element 6 is connected to an output terminal GATE of the control circuit block 7.

The control circuit block 7 of the embodiment includes a constant current source 14 and a regulator 19 for inputting the direct-current voltage $V_{IN}$ to output a constant reference voltage VCC, a current detection circuit 12 for detecting the current flowing into the switching element 6, a control circuit 70, and an input voltage detection circuit 18 and a start/stop circuit 11. The control circuit 70 is driven by applying the reference voltage VCC and controls on/off of the switching element 6 based on the output of the current detection circuit 12. The input voltage detection circuit 18 and the start/stop circuit 11 restrict the operation of the control circuit 70 based on the direct-current voltage $V_{IN}$. The control circuit block 7 also includes an input terminal VJ connected to the input terminal IN of the switching drive circuit 5.

The constant current source 14 is connected between an input terminal VJ and one end of the regulator 19. The input terminal VJ connected to the constant current source 14 may be connected to the high-potential-side terminal DRN instead of the input terminal IN of the switching drive circuit 5. The constant current source 14 outputs a voltage $V_J$ to the regulator 19.

The other end of the regulator 19 is connected to the reference voltage terminal VCC, and the regulator 19 outputs a reference voltage $V_{CC}$ to the reference voltage terminal VCC. The regulator 19 compares the voltage $V_J$ with a start-up voltage (start-up voltage $V_{CC0}$ of FIG. 8) which has a predetermined voltage value. When the voltage $V_J$ is smaller than the start-up voltage, the regulator 19 directly outputs the voltage $V_J$ as the reference voltage $V_{CC}$. When the voltage $V_J$ is not lower than the start-up voltage $V_{CC0}$, the regulator 19 outputs the reference voltage $V_{CC}$ which is of the constant voltage value $V_{CC0}$. The reference voltage $V_{CC}$ is accumulated in the capacitor 14. When the reference voltage $V_{CC}$ reaches the voltage value $V_{CC0}$, an internal circuit of the control circuit block 7 starts the operation.

When the voltage $V_J$ is smaller than the start-up voltage $V_{CC0}$, the regulator 19 outputs a low (L) signal which is of a stop signal to the start/stop circuit 11, and controls the start/stop circuit 11 so as not to start the on/off control of the switching element 6. When the voltage $V_J$ is not lower than the start-up voltage $V_{CC0}$, the regulator 19 outputs a high (H) signal which is of a start-up signal to the start/stop circuit 11, and controls the start/stop circuit 11 so as to start the on/off control of the switching element 6.

The control circuit block 7 also includes the ground terminal GND which is the ground potential. The ground terminal GND is connected to the low-potential-side terminal GND-SRCE of the switching drive circuit 5.

The input voltage detection circuit 18 includes resistors 15 and 16 which are connected in series between the input terminal IN and the ground terminal GND, and a comparator 17 which compares the voltage at an intermediate junction point between the resistors 15 and 16 with an input reference voltage $V_{st}$ which is of a predetermined value. The resistors 15 and 16 divide the direct-current voltage $V_{IN}$ inputted to the input terminal IN and output a dividing voltage $V_{IN18}$. A positive input terminal of the comparator 17 is connected to the intermediate junction point between the resistors 15 and 16 to input the dividing voltage $V_{IN18}$. A negative input terminal of the comparator 17 inputs the input reference voltage $V_{st}$. When the dividing voltage $V_{IN18}$ is lower than the input reference voltage $V_{st}$, the comparator 17 outputs the low (L) signal. When the dividing voltage $V_{IN18}$ is not lower than the input reference voltage $V_{st}$, the comparator 17 outputs the high (H) signal. The low signal outputted by the input voltage detection circuit 18 is an extinction signal for extinguishing the light emitting diode 2, and the high signal is a light emitting signal for causing the light emitting diode 2 to emit light. The output terminal of the comparator 17 is connected to the start/stop circuit 11.

The start/stop circuit 11 inputs signals which are output from regulator 19 and the output terminal of the comparator 17 of the input voltage detection circuit 18. The output of the start/stop circuit 11 is connected to an AND circuit 20 of the control circuit 70. The start/stop circuit 11 outputs the stop signal to the AND circuit 20 while the start/stop circuit 11 inputs the stop signal from the regulator 19, and the start/stop circuit 11 outputs the light emitting signal or extinction signal of the input voltage detection circuit 18 to the AND circuit 20 while the start/stop circuit 11 inputs the start-up signal from the regulator 19. That is, the start/stop circuit 11 outputs the high signal when both signals inputted from the regulator 19 and input voltage detection circuit 18 are the high signal, and the start/stop circuit 11 outputs the low signal when either of the signals inputted from the regulator 19 and input voltage detection circuit 18 is the low signal.

The current detection circuit 12 is a comparator which has the positive input terminal is connected to the high-potential-side terminal DRN to input the on-state voltage $V_{on}$ of the switching element 6, and the negative input terminal inputs a detection reference voltage $V_{sn}$ which is a reference. When the on-state voltage $V_{on}$ is smaller than the detection reference voltage $V_{sn}$, the current detection circuit 12 outputs the low signal. When the on-state voltage $V_{on}$ is not lower than the detection reference voltage $V_{sn}$, the current detection circuit 12 outputs the high signal. The current $I_D$ flowing into the switching element 6 is detected by comparing the on-state voltage $V_{on}$ of the switching element 6 with the detection reference voltage $V_{sn}$ of the current detection circuit 12.

The control circuit 70 includes an oscillator 13, AND circuits 20 and 24, an OR circuit 23, an RS flip-flop circuit 22, and an on-state blanking pulse generator 21.

The oscillator 13 outputs a maximum duty signal MXDTY and a clock signal CLK. The oscillation frequency and maximum on-duty of the switching element 6 are regulated by the clock signal CLK and the maximum duty signal MXDTY of the oscillator 13.

The input terminal of the AND circuit 24 is connected to the output terminals of the current detection circuit 12 and the on-state blanking pulse generator 21, and the output terminal of the AND circuit 24 is connected to one of the input terminals of the OR circuit 23.

The reverse signal of the maximum duty signal MXDTY of the oscillator 13 is inputted to the other input terminal of the OR circuit 23.

In the RS flip-flop circuit 22, a reset signal terminal R is connected to the output terminal of the OR circuit 23, and the clock signal CLK of the oscillator 13 is inputted to a set signal terminal S.

The input terminals of the AND circuit 20 are connected to the start/stop circuit 11, the output terminal of the oscillator 13 which outputs the maximum duty signal MXDTY, and an output terminal Q of the RS flip-flop circuit 22.

The control circuit block 7 includes the output terminal GATE connected to the control terminal of the switching element 6, and the output terminal of the AND circuit 20 is connected to the output terminal GATE.

One end of the on-state blanking pulse generator 21 is connected to the junction point between the AND circuit 20 and the output terminal GATE. The on-state blanking pulse generator 21 inputs the output signal of the AND circuit 20 and outputs the low signal for a predetermined time (for example, hundreds nano-seconds) since the switching element 6 is switched from the turn-off to the turn-on. The on-state blanking pulse generator 21 outputs the high signal at any time other than the predetermined time. In the third embodiment, the output signal of the on-state blanking pulse generator 21 and the output signal of the current detection circuit 12 are inputted to the AND circuit 24, which prevents a incorrect on/off control of the switching element 6 which is caused by ringing generated in transferring the switching element 6 from the off state to the on state.

Then, the operation of the light emitting diode drive apparatus of the third embodiment will be described with reference to FIG. 8. FIG. 8 shows the waveform of the direct-current voltage $V_{IN}$ outputted by the rectifier 9, the waveform of the current $I_{LED}$ flowing into the light emitting diode 2, and the waveform of the reference voltage $V_{CC}$ in the light emitting diode drive apparatus of the third embodiment. In FIG. 8, the horizontal axis indicates a time. As shown in FIG. 8, the direct-current voltage $V_{IN}$ outputted by the rectifier 9 has a waveform in which the alternating-current voltage is full wave rectified.

When the direct-current voltage $V_{IN}$ is applied to the input terminal VJ through the input terminal IN, the voltage $V_J$ outputted by the constant current source 14 is increased as the direct-current voltage $V_{IN}$ is increased. When the voltage $V_J$ is increased, the reference voltage $V_{CC}$ is increased by the regulator 19. Because the regulator 19 outputs the low signal which is of the stop signal to the start/stop circuit 11 while the reference voltage $V_{CC}$ reaches the start-up voltage $V_{CC0}$, the on/off control of the switching element 6 is not performed (stop period T3).

When the voltage $V_J$ reaches the start-up voltage $V_{CC0}$, the regulator 19 outputs the reference voltage $V_{CC}$ having the voltage value $V_{CC0}$, and the internal circuit of the control circuit block 7 starts the operation (start-up period T4). The oscillator 13 starts the output of the maximum duty signal MXDTY and the clock signal CLK. The regulator 19 outputs the high signal which is of the start-up signal to the start/stop circuit 11, which starts the control of the switching element 6. That is, the start/stop circuit 11 controls a light emitting period T1 or an extinction-period T2 of the light emitting diode 2 based on the light emitting signal or extinction signal outputted from the input voltage detection circuit 18.

When the dividing voltage $V_{IN18}$ reaches the input reference voltage $V_{st}$, the comparator 17 of the input voltage detection circuit 18 outputs the high signal which is of the light emitting signal to the start/stop circuit 11, and the start/stop circuit 11 outputs the high signal to the AND circuit 20 (light emitting period T1). Therefore, the control circuit 70 performs the on/off control of the switching element 6 to cause the light emitting diode 2 to emit light.

In the third embodiment, a voltage value $V_{IN1}$ of the voltage $V_{IN}$ at the time when the dividing voltage $V_{IN18}$ reaches the reference voltage $V_{st}$ is higher than a voltage value $V_{IN2}$ of the voltage $V_{IN}$ at the time when the voltage $V_J$ reaches the voltage value $V_{CC0}$.

When the dividing voltage $V_{IN18}$ is lower than the input reference voltage $V_{st}$, the comparator 17 of the input voltage detection circuit 18 outputs the low signal which is of the extinction signal to the start/stop circuit 11, and the start/stop circuit 11 outputs the low signal to the AND circuit 20 (extinction-period T2). Therefore, the switching element 6 is maintained at the off state and the light emitting diode 2 extinguishes light.

That is, the on/off control of the switching element 6 is intermittently performed to cause the light emitting diode 2 to emit light during the light emitting period T1 in which the dividing voltage $V_{IN18}$ is not lower than the input reference voltage $V_{st}$. On the other hand, the on/off control of the switching element 6 is stopped to cause the light emitting diode 2 to extinguish the light during the extinction-period T2 in which the dividing voltage $V_{IN18}$ is lower than the input reference voltage $V_{st}$. The constant current $I_{LED}$ flows into the light emitting diode 2 during the light emitting period T1, while the constant current $I_{LED}$ does not flow into the light emitting diode 2 during the extinction-period T2.

The reference voltage $V_{CC}$ outputted by the regulator 19 is accumulated in the capacitor 10. The regulator 19 performs the control such that the reference voltage $V_{CC}$ is always maintained at the constant voltage $V_{CC0}$ during the start-up period T4 in which the voltage $V_J$ is not lower than the start-up voltage $V_{CC0}$. The regulator 19 appropriately sets the capacitance value of the capacitor 10 such that the reference voltage $V_{CC}$ is not decreased during the start-up period T5 in which the voltage $V_{IN}$ is decreased and the voltage $V_J$ is lower than the voltage value $V_{CC0}$ again. The on/off control of the switching element 6 is performed to cause the light emitting diode 2 to repeat the light emission and the extinction during the start-up periods T4 and T5 in which the reference voltage $V_{CC}$ is maintained at the start-up voltage $V_{CC0}$.

Then, the constant current output operation in the light emitting period T1 of the light emitting diode drive apparatus of the third embodiment will be described. FIG. 2 shows the waveforms of each voltage and each current during the light emitting period T1. FIG. 2 sequentially shows the waveform of the output voltage $V_{IN}$ outputted by the direct-current power supply 1, the waveform of the voltage $V_D$ between the high-potential-side terminal of the switching element 6 and the reference potential, the waveform of the current $I_D$ flowing into the switching element 6, the waveform of the current $I_{LED}$ flowing into the light emitting diode 2, and the waveform of the forward voltage $V_{LED}$ of the light emitting diode 2 (that is, the waveform of the voltage difference between the anode terminal and the cathode terminal).

During the light emitting period T1, the oscillation frequency and maximum on-duty of the switching element 6 are regulated by the clock signal CLK and the maximum duty signal MXDTY of the oscillator 13.

The voltage $V_D$ of the switching element 6 is the voltage value $V_{on}$ while the switching element 6 is turned on. When the on-voltage $V_{on}$ reaches the voltage value $V_{sn}$, the current detection circuit 12 outputs the high level signal. The high level signal is inputted to the OR circuit 23 through the AND circuit 24, and the OR circuit 23 outputs the high level signal. Even if the on-voltage $V_{on}$ does not reach the voltage value $V_{sn}$, the OR circuit 23 outputs the high level signal when the reverse signal of the maximum duty signal MXDTY becomes the high level. The high level signal is inputted to the reset signal terminal R of the RS flip-flop 22. The RS flip-flop 22 is reset to output the low level signal to the AND circuit 20. The AND circuit 20 outputs the low level signal, which causes the switching element 6 to be in the off state.

When the clock signal CLK of the oscillator 13 is inputted to the set signal terminal S of the RS flip-flop 22, the switching element 6 becomes the on state.

The on-state blanking pulse generator 21 outputs the low signal for a predetermined time since the switching element 6 is switched from off to on. The low signal is inputted to the AND circuit 24, so that the output signal of the current detection circuit 12 has no influence on the on/off control of the switching element 6. The on-state blanking pulse generator 21 outputs the high signal after a predetermined time elapses. The on/off control of the switching element 6 is performed based on the output signal of the current detection circuit 12.

When the on-state voltage $V_{on}$ of the switching element 6 reaches the voltage value $V_{sn}$, or when the reverse signal of the maximum duty signal MXDTY becomes the high level, the OR circuit 23 outputs the high level signal to reset the RS flip-flop 22. Therefore, the switching element 6 becomes the off state again.

That is, the on-duty of the switching element 6 is regulated by the output signal of the OR circuit 23 to which the reverse signal of the maximum duty signal MXDTY of the oscillator 13 and the output signal of the current detection circuit 12 are inputted.

Figure 8:
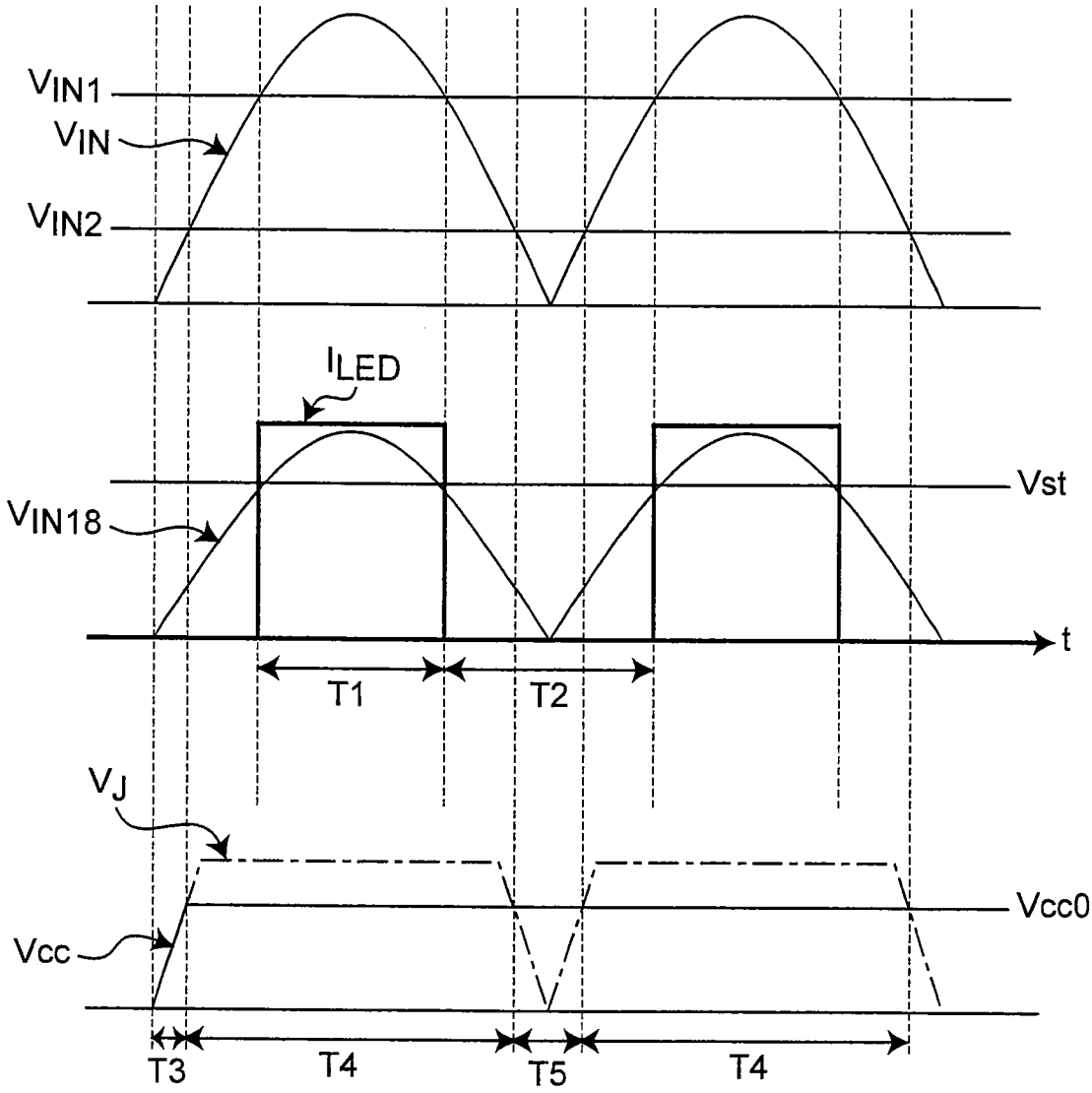
FIG. 8 shows a period during which the current is flowing into the light emitting diode in the third embodiment.

Thus, when the on/off control of the switching element 6 is intermittently performed during the light emitting period T1 of FIG. 8 by the control circuit block 7, the current $I_{LED}$ flowing into the light emitting diode 2 becomes shown in FIG. 2.

When the switching element 6 is turned on, the current $I_{LED}$ flows into the light emitting diode 2 in the direction of the light emitting diode 2→the choke coil 3→the switching element 6. When the switching element 6 is turned off, the current $I_{LED}$ flows into a closed loop of the choke coil 3→the rectifier diode 4→the light emitting diode 2. Therefore, the current flowing into the choke coil 3 (that is, the current flowing into the light emitting diode 2) has the waveform shown by the current $I_{LED}$ of FIG. 2.

The forward voltage $V_{LED}$ of the light emitting diode 2 is slowly increased in association with the increase in current $I_{LED}$ which flows into the light emitting diode 2 when the switching element 6 is turned on. The forward voltage $V_{LED}$ is slowly decreased in association with the decrease in current $I_{LED}$ which flows into the light emitting diode 2 when the switching element 6 is turned off.

When the switching element 6 is turned on, the voltage at the junction point L1 between the choke coil 3 and the switching element 6 is decreased to the on-state voltage $V_{on}$ of the switching element 6. However, because the voltage at the junction point L2 between the light emitting diode 2 and the choke coil 3 does not fluctuate largely, the potential between the terminals of the light emitting diode 2 does not fluctuate largely at the moment when the switching element 6 is turned on.

When the switching element 6 is turned off, the potential difference between both terminals of the choke coil 3 becomes the total value ($V_{LED}+V_F$) of the forward voltage $V_{LED}$ of the light emitting diode 2 and the forward voltage $V_F$ of the rectifier diode 4 by the back electromotive force generated in the choke coil 3. Because the voltage at the junction point L2 between the light emitting diode 2 and the choke coil 3 is fixed to the voltage ($V_{IN}-V_{LED}$) which is lower than the output voltage $V_{IN}$ Of the direct-current power supply 1 by the forward voltage $V_{LED}$ of the light emitting diode 2, the voltage of the junction point L1 between the choke coil 3 and the switching element 6 is instantaneously increased to the voltage ($V_{IN}+V_F$) which is obtained by adding the potential difference ($V_{LED}+V_F$) generated between both terminals of the choke coil 3 to the voltage ($V_{IN}-V_{LED}$) of the junction point L2 between the diode 2 and the choke coil 3. However, because the voltage at the junction point L2 between the diode 2 and the choke coil 3 does not fluctuate largely, the potential between both terminals of the light emitting diode 2 does not fluctuate largely at the moment when the switching element 6 is turned off.

Thus, when the choke coil 3 is connected between the switching element 6 and the light emitting diode 2 as described in the third embodiment, the potential between the terminals of the light emitting diode 2 does not fluctuate largely, even if the voltage of the junction point L1 between the choke coil 3 and the switching element 6 fluctuates largely when the switching element 6 switches between turn-on and turn-off. Therefore, the large current is not charged in the parasitic capacitance of the light emitting diode. The light emitting diode 6 does not become the noise source, but the conducted emission transferred to the direct-current power supply 1 can be decreased.

In FIG. 7, the detection reference voltage $V_{sn}$ is the predetermined voltage value. However, an external detection terminal (not shown) for receiving the detection reference voltage $V_{sn}$ from outside may be provided in the switching drive circuit 5. In this case, a peak current value of the current $I_D$ flowing into the switching element 6 can be changed by arbitrarily setting and changing the voltage value of the detection reference voltage $V_{sn}$. Therefore, the current value of the current $I_{LED}$ flowing into the light emitting diode 2 can be changed to realize the light emitting diode drive apparatus having the brightness control function.

In the third embodiment, the input reference voltage $V_{st}$ is the predetermined voltage value. However, an external connection terminal (not shown) for receiving the input reference voltage $V_{st}$ from outside may be provided in the switching drive circuit 5. An length of the light emitting period T1 during which the current $I_{LED}$ is flowing into the light emitting diode 2 can simply be adjusted by arbitrarily setting and changing the voltage value of the input reference voltage $V_{st}$.

In the case where a commercial power supply is used as the alternating-current power supply 8, the light emitting period T1 and the extinction-period T2 can easily be adjusted in the double period (100 Hz/120 Hz), and chromaticity and light intensity can easily be adjusted.

The following effects are further obtained in the used of the light emitting diode drive apparatus of the third embodiment. The resistor for supplying the electric power is not required in the switching drive circuit of the third embodiment, so that electric power loss is not generated in the start-up. Generally, the electric power supply to the switching drive circuit is performed in a direct-current manner from the input voltage (high voltage) through the resistor. Because this electric power supply is performed not only in the start-up and stop but in the normal operation, the electric power loss is generated by the resistor. However, according to the configuration of the third embodiment, the resistor is not required.

In the current $I_D$ flowing into the switching element 6, the on-state voltage $V_{on}$ of the switching element 6 is detected by the current detection circuit 12. Therefore, the conventional detection resistor for detecting the current is not required, and the electric power loss is not generated by the detection resistor.

In FIG. 7, the miniaturization of the light emitting diode drive apparatus can be realized by forming the switching element 6 and control circuit block 7 in the switching drive circuit 5 in the same substrate. The same holds for the following embodiments.

In FIG. 7, the full wave rectifier 9 is used as the means for rectifying the alternating-current voltage. However, the same effect is clearly obtained even if a half-wave rectifier is used. The same holds for the following embodiments.

A clamp circuit such as the zener diode may be connected in parallel to the high-potential-side terminal DRN and the low-potential-side terminal GND-SRCE of the switching element 6. In the intermittent on/off control of the switching element 6 by the control circuit block 7, when the switching element 6 turns from on to off, sometimes the high-potential-side voltage $V_D$ of the switching element 6 exceeds the withstand voltage of the switching element 6 due to the ringing generated by wiring capacitance or wiring inductance. In this case, the switching element 6 may be broken down. Therefore, the clamp circuit having a clamping voltage lower than the withstand voltage of the switching element 6 is connected in parallel to clamp the voltage $V_D$ of the switching element 6 with the clamping voltage, and the break-down of the switching element 6 can be prevented. Accordingly, the light emitting diode drive apparatus having high-safety can be realized. In the following embodiments, the same effect can be obtained by the addition of the clamp circuit.

During a transition state in which the switching element 6 transfers from the off state to the on state, because the electric power loss is increased when a reversal recovery time (Trr) of the rectifier diode 4 is delayed, the reversal recovery time (Trr) of the rectifier diode 4 is not more than 100 nsec in the third embodiment.

Fourth Embodiment

Figure 9:
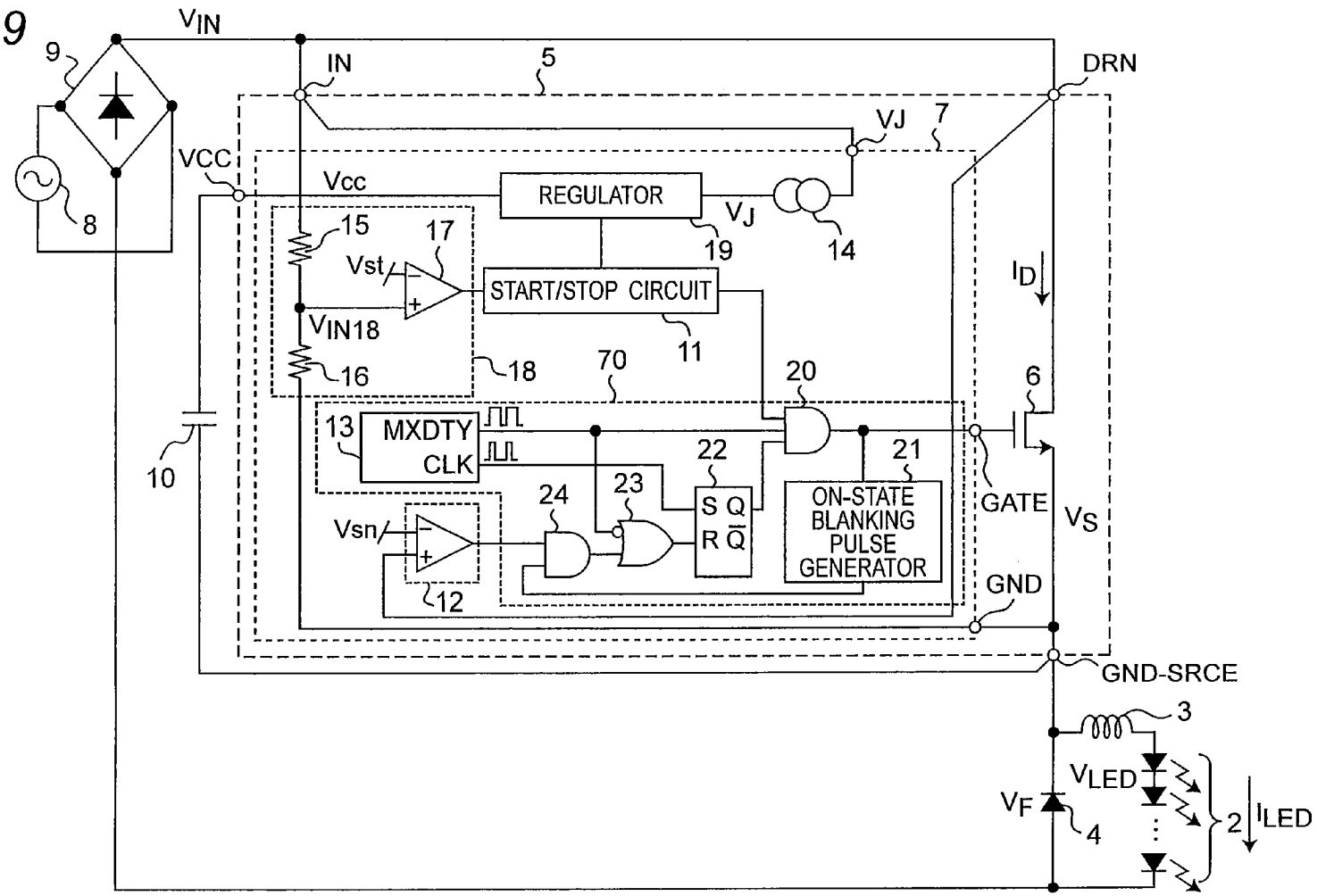
FIG. 9 is a circuit diagram showing a light emitting diode drive apparatus according to a fourth embodiment of the invention.

A light emitting diode drive apparatus according to a fourth embodiment of the invention will be described with reference to FIG. 9. FIG. 9 shows the light emitting diode drive apparatus of the fourth embodiment. The fourth embodiment concretely shows an example of the control circuit block 7 of the second embodiment. That is, the switching drive circuit 5 is connected between the high potential side of the rectifier 9 and one end of the choke coil 3, and the other end of the choke coil 3 is connected to the anode terminal of the light emitting diode 2. The internal circuit of the control circuit block 7 of the fourth embodiment is the same as the internal circuit of the control circuit block 7 of the third embodiment.

As similar to the third embodiment, the alternating-current power supply 8 for generating the alternating-current voltage is used as the voltage source of the fourth embodiment, and the rectifier 9 is connected to the alternating-current power supply 8. In the fourth embodiment, the rectifier 9 is a full wave rectifier which outputs the full wave rectified direct-current voltage $V_{IN}$.

In the fourth embodiment, the high potential side of the rectifier 9 is connected to the input terminal IN and high-potential-side terminal DRN of the switching drive circuit 5. The low-potential-side terminal GND-SRCE of the switching drive circuit 5 is connected to one end of the choke coil 3 and the cathode terminal of the rectifier diode 4. The other end of the choke coil 3 is connected to the anode terminal of the light emitting diode 2. The cathode terminal of the light emitting diode 2 and the anode terminal of the rectifier diode 4 are connected to the low-potential-side terminal of the rectifier 9.

The low-potential-side terminal GND-SRCE of the switching drive circuit 5 is connected to the ground terminal GND of the control circuit block 7, and the low-potential-side terminal GND-SRCE becomes the reference potential of the switching drive circuit 5. The capacitor 10 is connected between the reference voltage terminal VCC and the low-potential-side terminal GND-SRCE.

According to the above configuration, the same switching drive circuit 7 as the third embodiment can be used even in the circuit configuration in which the switching drive circuit 5 is arranged on the potential side higher than the light emitting diode 2. The fourth embodiment can obtain the same effect as the third embodiment.

Fifth Embodiment

Figure 10:
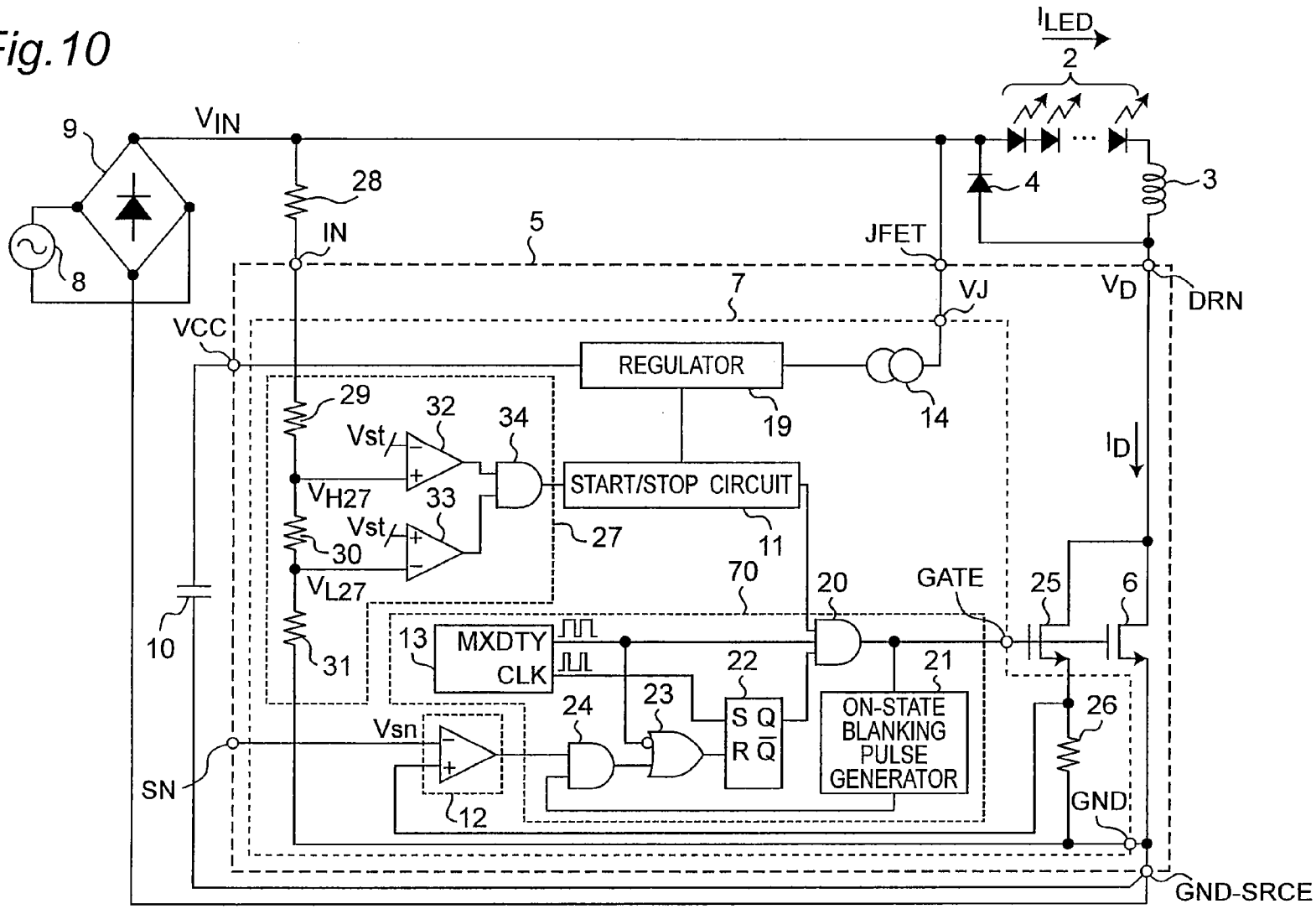
FIG. 10 is a circuit diagram showing a light emitting diode drive apparatus according to a fifth embodiment of the invention.

A light emitting diode drive apparatus according to a fifth embodiment of the invention will be described with reference to FIGS. 10 and 11. FIG. 10 shows the light emitting diode drive apparatus of the fifth embodiment. The light emitting diode drive apparatus of the fifth embodiment differs from that of the third embodiment in the following points.

The light emitting diode drive apparatus of the fifth embodiment further includes a resistor 28 connected between the input terminal IN and the rectifier 9.

In addition to the input terminal IN, the switching drive circuit 5 further includes an input terminal JFET which inputs the direct-current voltage $V_{IN}$ not through the resistor 28. The input terminal VJ is connected to the input terminal JFET, and the direct-current voltage $V_{IN}$ is inputted to the constant current source 14.

The input voltage detection circuit 27 of the fifth embodiment includes three resistors 29, 30, and 31 which are connected in series between the input terminal IN and the ground terminal GND, a first comparator 32 having a positive input terminal for inputting a first dividing voltage $V_{H27}$ outputted from the junction point between the resistor 29 and the resistor 30 and having a negative input terminal for inputting the input reference voltage $V_{st}$, a second comparator 33 having a negative input terminal for inputting a second dividing voltage $V_{L27}$ outputted from the junction point between the resistor 30 and the resistor 31 and having a positive input terminal for inputting the input reference voltage $V_{st}$, and an AND circuit 34 having input terminals which are connected to the output terminals of the first comparator 32 and second comparator 33. The output terminal of the AND circuit 34 is connected to the start/stop circuit 11. At this point, a relationship of $V_{H27}>V_{L27}$ always holds in the first dividing voltage $V_{H27}$ and the second dividing voltage $V_{L27}$.

The control circuit block 7 of the fifth embodiment also includes a switching element 25 and a resistor 26. The switching element 25 is connected in parallel with the switching element 6. The current having a constant current ratio, which is smaller than the current flowing into the switching element 6, flows into the switching element 25. The high potential side of the switching element 25 is connected to the high potential side of the switching element 6. The control terminal of the switching element 25 is connected to the output terminal GATE of the control circuit block 7 in common with the control terminal of the switching element 6. The resistor 26 is connected between the low potential side of the switching element 25 and the ground terminal GND.

The current detection circuit 12 detects the current flowing into the switching element 25 by the voltage between the both ends of the resistor 26, and compares the detected voltage with the detection reference voltage $V_{sn}$.

The switching drive circuit 5 of the fifth embodiment also includes an external detection terminal SN, and outputs the detection reference voltage $V_{sn}$ inputted to the external detection terminal SN to the current detection circuit 12.

The fifth embodiment is similar to the third embodiment shown in FIG. 7 except for the above configurations.

The operation of the light emitting diode drive apparatus of the fifth embodiment will be described below with reference to FIG. 11. FIG. 11 shows the waveform of the current $I_{LED}$ flowing into the light emitting diode 2, the waveform of the first dividing voltage $V_{H27}$, and the waveform of the second dividing voltage $V_{L27}$. In FIG. 11, the horizontal axis indicates time t.

The first comparator 32 outputs the low level signal during an extinction period T2A until the first dividing voltage $V_{H27}$ reaches the input reference voltage $V_{st}$. On the other hand, the second comparator 33 outputs the high level signal because the second dividing voltage $V_{L27}$ is lower than the input reference voltage $V_{st}$. The output signal of the AND circuit 34 to which the output signals of the two comparators 32 and 33 are inputted becomes the low level, and the start/stop circuit 11 outputs the low signal which is of the extinction signal to the AND circuit 13. The control circuit block 7 stops the control of the switching element 6 (extinction period T2A).

When the direct-current voltage $V_{IN}$ is increased and the first dividing voltage $V_{H27}$ reaches the input reference voltage $V_{st}$, the first comparator 32 outputs the high level signal. On the other hand, the second comparator 33 outputs the high level signal because the second dividing voltage $V_{L27}$ is lower than the input reference voltage $V_{st}$. The output signal of the AND circuit 34 to which the output signals of the two comparators 32 and 33 are inputted becomes the high level, and the start/stop circuit 11 outputs the high signal which is of the light emitting signal to the AND circuit 13. The control circuit block 7 starts the intermittent on/off control of the switching element 6, and the light emitting diode 2 emits light (light emitting period T1).

When the direct-current voltage $V_{IN}$ is further increased and the second dividing voltage $V_{L27}$ reaches the input reference voltage $V_{st}$, the second comparator 33 outputs the low level signal. On the other hand, the first comparator 32 continues to output the high level signal because the first dividing voltage $V_{H27}$ is higher than the input reference voltage $V_{st}$. The output signal of the AND circuit 34 to which the output signals of the two comparators 32 and 33 are inputted becomes the low level, and the start/stop circuit 11 outputs the low signal which is of the extinction signal to the AND circuit 13. The control circuit block 7 stops the control of the switching element 6 (extinction period T2B).

Then, when the direct-current voltage $V_{IN}$ is decreased, the second dividing voltage $V_{L27}$ becomes lower than the input reference voltage $V_{st}$ again, and the switching element 6 becomes the oscillation state (light emitting period T1).

When the first dividing voltage $V_{H27}$ is lower than the input reference voltage $V_{st}$, the switching element 6 becomes the stop state (extinction period T2A).

Figure 11:
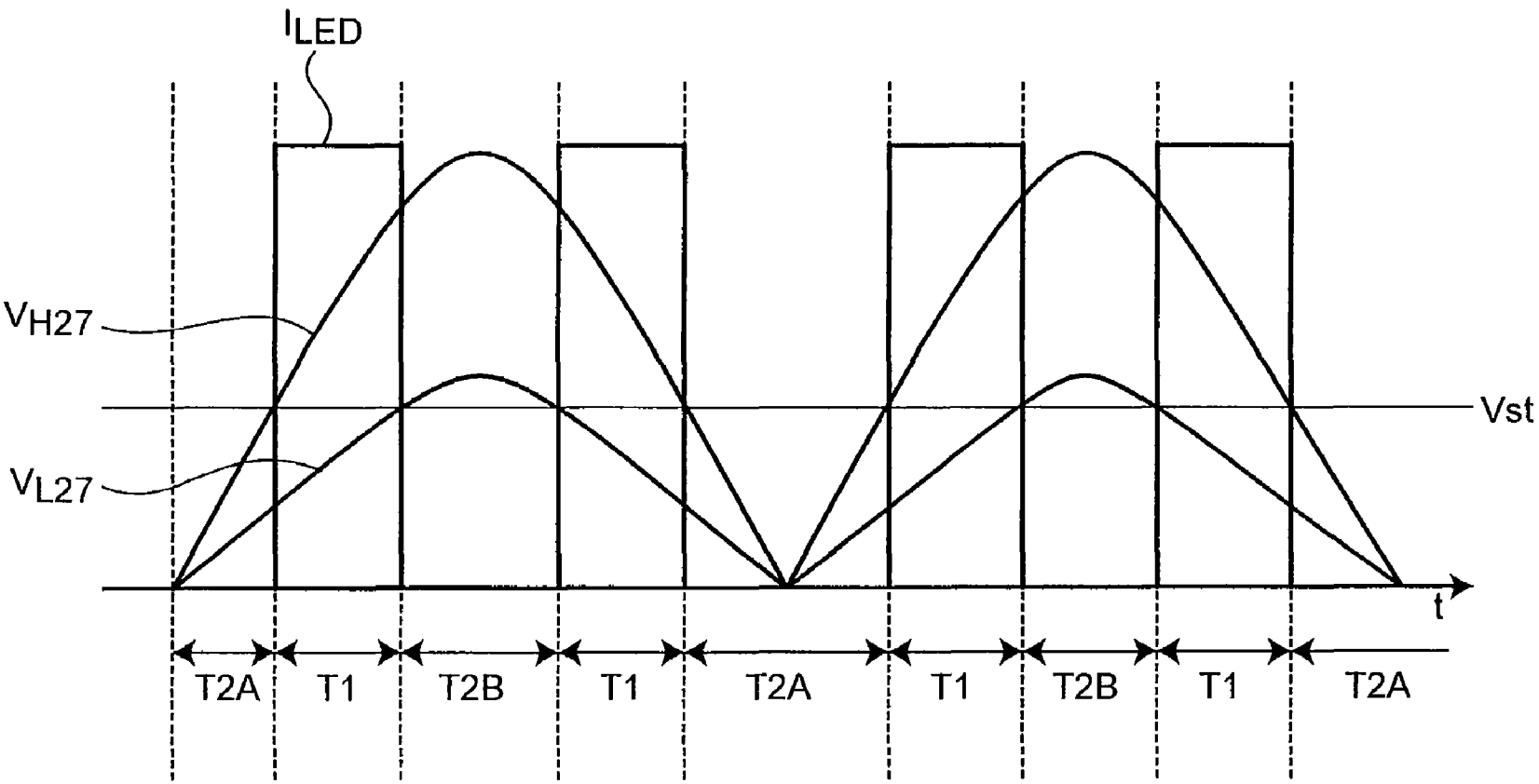
FIG. 11 shows a period during which the current is flowing into the light emitting diode in the fifth embodiment; A1

As shown in FIG. 11, during the extinction period T2A, in which the first dividing voltage $V_{H27}$ is lower than the input reference voltage $V_{st}$, because the control circuit block 7 stops the on/off control of the switching element 6 to hold the switching element 6 the off state, the light emitting diode 2 extinguishes light. On the other hand, the control circuit block 7 performs the on/off control of the switching element 6 to cause the light emitting diode 2 to emit light during the light emitting period T1 in which the first dividing voltage $V_{H27}$ is higher than the input reference voltage $V_{st}$, and the second dividing voltage $V_{L27}$ is lower than the input reference voltage $V_{st}$. During the extinction-period T2B in which the second dividing voltage $V_{L27}$ is higher than the input reference voltage $V_{st}$, the control circuit block 7 stops the on/off control of the switching element 6 to hold the switching element 6 the off state, so that the light emitting diode 2 extinguishes light.

According to the fifth embodiment, the following effects are obtained in addition to the effects of the first and third embodiments. An upper limit and a lower limit of the voltage level in range in which the on/off control of the switching element 6 can be performed can be set for the change in direct-current voltage $V_{IN}$. The input voltage detection circuit 27 becomes the protective circuit in the case where the extraordinary high voltage is applied, so that the fifth embodiment can realize the high-safety light emitting diode drive apparatus.

The upper limit and the lower limit of the voltage level in which the on/off control of the switching element 6 can be performed can arbitrarily be set for the change in direct-current voltage $V_{IN}$ by changing the value of the resistor 28. Therefore, the higher-safety light emitting diode drive apparatus which can adjust the complicated light intensity can be realized. The electric power loss generated by the resistors 29, 30, and 31 of the input voltage detection circuit 27 can be decreased by the use of a high resistance as the resistor 28.

The input voltage detection circuit 27 of the fifth embodiment has the three serially connected resistors to generate the first dividing voltage $V_{H27}$ and the second dividing voltage $V_{L27}$. However, the invention is not limited to the input voltage detection circuit 27 of the fifth embodiment, but the internal configuration of the input voltage detection circuit 27 may be formed such that the upper limit and the lower limit of the voltage level in which the on/off control of the switching element 6 can be performed is regulated for the change in direct-current voltage $V_{IN}$.

When the resistor 28 is not used, the input terminal IN and the input terminal JFET can become common. In this case, the high potential side of the resistor 29 of the input voltage detection circuit 27 and the input terminal VJ can be connected to the same input terminal IN (or JFET).

A smoothing capacitor (not shown) may be connected to the high potential side and the low potential side of the rectifier 9. In the case where the smoothing capacitor is added to the high potential side and the low potential side of the rectifier 9, the direct-current voltage $V_{IN}$ can be regarded as the direct-current voltage having a certain ripple voltage width. In this case, the input voltage detection circuit 27 acts as the protective circuit which stops the switching drive circuit 5 to protect the switching drive circuit 5 when the rectifier 9 or the smoothing capacitor is broken down and the direct-current voltage $V_{IN}$ becomes an extraordinary voltage.

The resistor 26 and the internal circuit configuration of the switching drive circuit 5 in the fifth embodiment can be applied to the fourth embodiment shown in FIG. 9.

Sixth Embodiment

Figure 12:
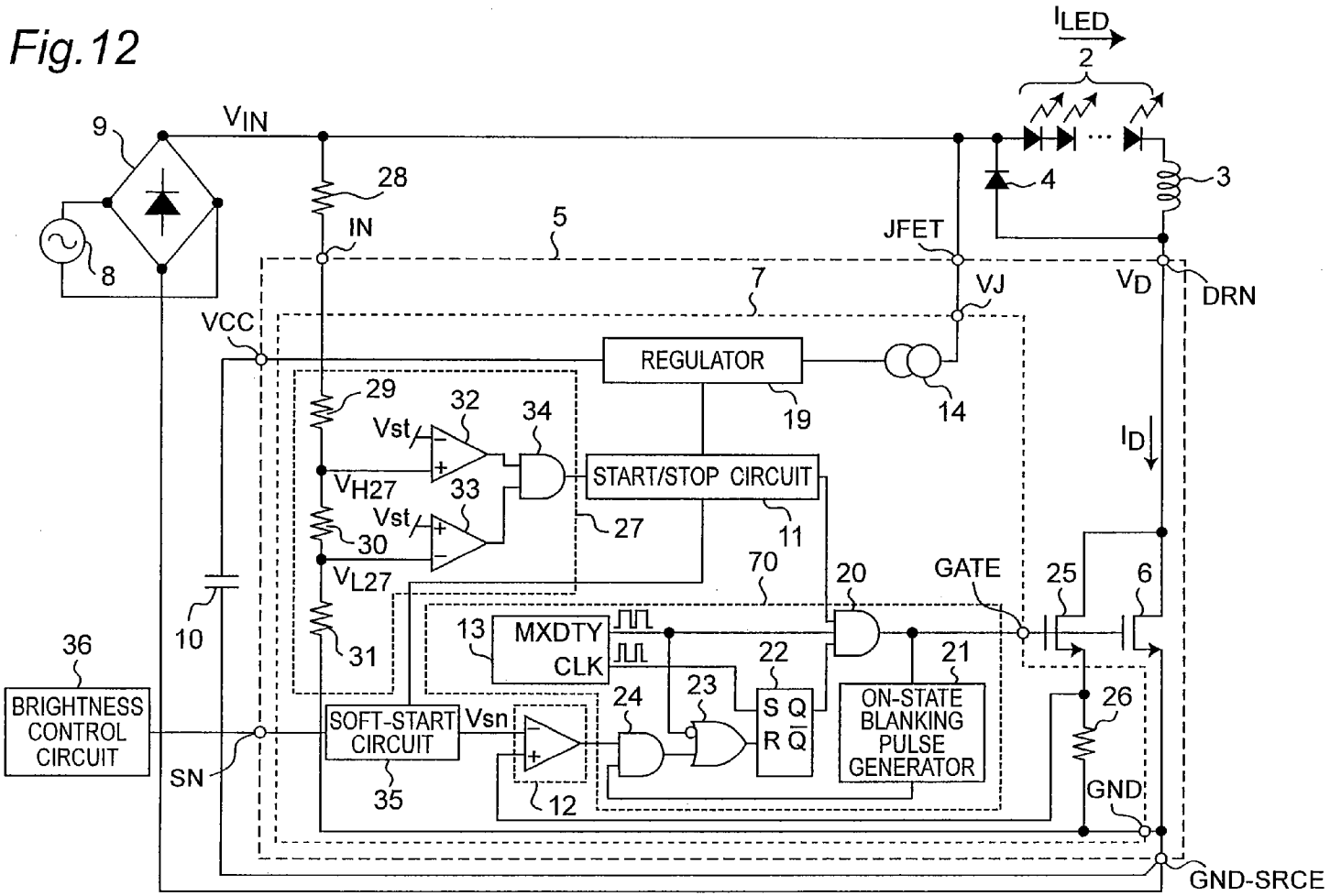
FIG. 12 is a circuit diagram showing a light emitting diode drive apparatus according to a sixth embodiment of the invention.

A light emitting diode drive apparatus according to a sixth embodiment of the invention will be described with reference to FIG. 12. FIG. 12 shows the light emitting diode drive apparatus of the sixth embodiment. The light emitting diode drive apparatus of the sixth embodiment differs from that of the fifth embodiment shown in FIG. 10 in that a soft-start circuit 35 and a brightness control circuit 36 are added. Other configurations of the sixth embodiment are similar to those of the fifth embodiment.

The soft-start circuit 35 is connected between the external detection terminal SN and the current detection circuit 12. The soft-start circuit 35 is also connected to the start/stop circuit 11. When the soft-start circuit 35 inputs the high (H) signal which is of the light emitting signal from the start/stop circuit 11, the soft-start circuit 35 outputs the detection reference voltage $V_{sn}$ such that the detection reference voltage $V_{sn}$ is gradually increased until the detection reference voltage $V_{sn}$ reaches a constant value. According to the above configuration, the rush current generated in the start-up can be prevented. The current $I_{LED}$ flowing into the light emitting diode 2 can gradually be increased by gradually increasing the detection reference voltage $V_{sn}$. Therefore, the light intensity of the light emitting diode can gradually be enhanced.

The brightness control circuit 36 is connected to the external detection terminal SN. For example, when an 8-bit microcomputer is used as the brightness control circuit 36, 256-level light control can be performed according to an external signal.

In case that a fixed resistor and a variable resistor are connected in series between the reference voltage terminal VCC and the ground terminal GND and the voltage divided by the two resistors is inputted to the external detection terminal SN, nonstop light control can be performed by changing the value of the variable resistor.

According to the sixth embodiment, in addition to the effects of the first to fifth embodiments, there is an advantage that the light emitting diode drive apparatus having the brightness control function is realized with the simple configuration.

The soft-start circuit 35 and the brightness control circuit 36 of the sixth embodiment can be applied to the fourth embodiment shown in FIG. 9.

The invention can be applied to the apparatus and instrument which uses the light emitting diode. Particularly the invention is suitable for the LED illumination apparatus.

Although the present invention has been described in connection with specified embodiments thereof, many other modifications, corrections and applications are apparent to those skilled in the art. Therefore, the present invention is not limited by the disclosure provided herein but limited only to the scope of the appended claims. The present disclosure relates to subject matter contained in Japanese Patent Application No. 2006-012603, filed on Jan. 20, 2006, which is expressly incorporated herein by reference in its entirety.

What is claimed is:

1. A light emitting diode drive apparatus comprising:

at least one light emitting diode;

a choke coil;

a switching drive circuit which includes a switching element and a control circuit block, the switching element determining whether a current is applied or not applied to the light emitting diode, the control circuit block controlling on/off timing of the switching element to control the current flowing into the light emitting diode; and a rectifier which supplies a back electromotive force generated in the choke coil to the light emitting diode, wherein an anode terminal of the light emitting diode is connected to a voltage source, one end of the choke coil is connected to a cathode terminal of the light emitting diode, an anode terminal of the rectifier diode is connected to other end of the choke coil, a cathode terminal of the rectifier diode is connected to the anode terminal of the light emitting diode, and the switching drive circuit is connected between the other end of the choke coil and a reference potentials, wherein the choke coil is provided in a path between the light emitting diode and the switching element not through the rectifier diode.

2. The light emitting diode drive apparatus according to claim 1, wherein the light emitting diode includes a light emitting element and a capacitor which are connected in parallel.

3. The light emitting diode drive apparatus according to claim 1, wherein the light emitting diode includes a light emitting element and a zener diode which is connected in antiparallel between the anode terminal and the cathode terminal of the light emitting element.

4. The light emitting diode drive apparatus according to claim 1, further comprising a rectifier which rectifies an alternating-current voltage when a voltage source is an alternating-current power supply which outputs the alternating-current voltage.

5. The light emitting diode drive apparatus according to claim 1, further comprising a protective element which is connected in parallel to both terminals of the light emitting diode to protect the light emitting diode against an electrostatic discharge damage.

6. A light emitting diode drive apparatus comprising:

at least one light emitting diode;

a choke coil;

a switching drive circuit which includes a switching element and a control circuit block, the switching element determining whether a current is applied or not applied to the light emitting diode, the control circuit block controlling on/off timing of the switching element to control the current flowing into the light emitting diode; and a rectifier diode which supplies a back electromotive force generated in the choke coil to the light emitting diode, wherein a cathode terminal of the light emitting diode is connected to a reference potential, one end of the choke coil is connected to an anode terminal of the light emitting diode, a cathode terminal of the rectifier diode is connected to other end of the choke coil, an anode terminal of the rectifier diode is connected to the cathode terminal of the light emitting diode, and the switching drive circuit is connected between a voltage source and the other end of the choke coils, wherein the choke coil is provided in a path between the light emitting diode and the switching element not through the rectifier diode.

7. The light emitting diode drive apparatus according to claim 6, further comprising a protective element which is connected in parallel to both terminals of the light emitting diode to protect the light emitting diode against an electrostatic discharge damage.

8. The light emitting diode drive apparatus according to claim 6, wherein the light emitting diode includes a light emitting element and a capacitor which are connected in parallel.

9. The light emitting diode drive apparatus according to claim 6, wherein the light emitting diode includes a light emitting element and a zener diode which is connected in antiparallel between the anode terminal and the cathode terminal of the light emitting diode.

10. The light emitting diode drive apparatus according to claim 6, further comprising a rectifier which rectifies an alternating-current voltage when a voltage source is an alternating-current power supply which outputs the alternating-current voltage.

11. A light emitting diode drive apparatus comprising:

at least one light emitting diode;

a choke coil;

a switching drive circuit which includes a switching element and a control circuit block, the switching element determining whether a current is applied or not applied to the light emitting diode, the control circuit block controlling on/off timing of the switching element to control the current flowing into the light emitting diode, the choke coil being connected between the light emitting diode and the switching drive circuit; and a rectifier which rectifies an alternating-current voltage when a voltage source is an alternating-current power supply which outputs the alternating-current voltage, wherein the control circuit block includes:

a constant current source of which one end is connected to the rectifier;

a regulator which is connected to other end of the constant current source, the regulator outputting a start-up signal when an output voltage of the constant current source is not lower than a predetermined value, the regulator outputting a stop signal when the output voltage of the constant current source is lower than the predetermined value;

a current detection circuit which detects a current flowing into the switching element;

a control circuit which intermittently performs on/off control of the switching element at a predetermined oscillation frequency based on an output signal of the current detection circuit such that the current flowing into the light emitting diode is kept constant; and a start/stop circuit which controls a start and a stop of the control circuit based on the start-up signal and the stop signal from the regulator.

12. The light emitting diode drive apparatus according to claim 11, further comprising an input voltage detection circuit which detects a voltage outputted from the rectifier and compares the detected voltage with a predetermined value to output a light emitting signal or an extinction signal for controlling light emission or extinction of the light emitting diode respectively, wherein the start/stop circuit outputs the stop signal to the control circuit when the regulator outputs the stop signal, and outputs the light emitting signal or the extinction signal of the input voltage detection circuit to the control circuit when the regulator outputs the start-up signal.

13. The light emitting diode drive apparatus according to claim 11, further comprising a capacitor of which one end is connected to the regulator and other end is connected to a reference potential of the rectifier or the choke coil.

14. The light emitting diode drive apparatus according to claim 11, wherein the current detection circuit detects the current flowing into the switching element by comparing an on-state voltage of the switching element with a detection reference voltage being a reference.

15. The light emitting diode drive apparatus according to claim 11, wherein the switching drive circuit further includes:

another switching element of which one end connected to a junction point between the choke coil and the switching element to switch by the same control as the switching element by the control circuit, a current flowing into the other switching device, the current being less than a current flowing into the switching element and having a constant current ratio to the current flowing into the switching element; and a resistor which is connected in series between other end of the other switching element and a reference potential, and the current detection circuit detects the current of the switching element by comparing a voltage between both ends of the resistor with the detection reference voltage being reference.

16. The light emitting diode drive apparatus according to claim 14, wherein the switching drive circuit further includes an external detection terminal connected to the current detection circuit, and an on-period in the intermittent on/off control of the switching element is changed to adjust a level of a constant current flowing into the light emitting diode by changing a value of the detection reference voltage inputted to the external detection terminal.

17. The light emitting diode drive apparatus according to claim 16, further comprising a soft-start circuit which is connected between the current detection circuit and the external detection terminal to which the detection reference voltage is inputted, wherein the soft-start circuit outputs the detection reference voltage such that the detection reference voltage is gradually increased until the detection reference voltage reaches a constant value when the light emitting signal is inputted from the start/stop circuit.

18. The light emitting diode drive apparatus according to claim 15, wherein the switching drive circuit further includes an external detection terminal connected to the current detection circuit, and an on-period in the intermittent on/off control of the switching element is changed to adjust a level of a constant current flowing into the light emitting diode by changing a value of the detection reference voltage inputted to the external detection terminal.

19. The light emitting diode drive apparatus according to claim 18, further comprising a soft-start circuit which is connected between the current detection circuit and the external detection terminal to which the detection reference voltage is inputted, wherein the soft-start circuit outputs the detection reference voltage such that the detection reference voltage is gradually increased until the detection reference voltage reaches a constant value when the light emitting signal is inputted from the start/stop circuit.

20. The light emitting diode drive apparatus according to claim 12, wherein the input voltage detection circuit includes:

a plurality of resistors connected in series, the resistors being applied with the output voltage of the rectifier directly or through a resistor inserted between the rectifier and the input voltage detection circuit; and a comparator having a positive input terminal which is applied with a direct-current voltage divided by the plurality of resistors, and having a negative input terminal which is applied with an input reference voltage being a reference.

21. The light emitting diode drive apparatus according to claim 12, wherein the input voltage detection circuit includes:

a plurality of resistors which are applied with the output voltage of the rectifier directly or through a resistor inserted between the rectifier and the input voltage detection circuit, the plurality of resistors outputting a first dividing voltage and a second dividing voltage lower than the first dividing voltage;

a first comparator having a positive input terminal which is applied with the first dividing voltage, and having a negative input terminal which is applied with an input reference voltage being a reference;

a second comparator having a negative input terminal which is applied with the second dividing voltage, and having a positive input terminal which is applied with the input reference voltage; and an AND circuit which receives output signals of the first and second comparators.

* * * * *

UNITED STATES PATENT AND TRADEMARK OFFICE

CERTIFICATE OF CORRECTION

PATENT NO. : 7,638,954 B2
APPLICATION NO. : 11/623363
DATED : December 29, 2009
INVENTOR(S) : Takashi Kunimatsu et al.

It is certified that error appears in the above-identified patent and that said Letters Patent is hereby corrected as shown below:

At Column 23, line 7 of claim 1, "reference potentials," should read --reference potential,--

At Column 23, line 50 of claim 6, "choke coils," should read --choke coil,--

Signed and Sealed this

Twenty-ninth Day of June, 2010

David J. Kappos

David J. Kappos
*Director of the United States Patent and Trademark Office*